US009009918B2

(12) United States Patent
Haab et al.

(10) Patent No.: US 9,009,918 B2
(45) Date of Patent: Apr. 21, 2015

(54) ADJUSTABLE CARRIAGE AND SHIFTING DEVICE

(71) Applicant: Hawa AG, Mettmenstetten (CH)

(72) Inventors: Gregor Haab, Allenwinden (CH); Peter Ettmüller, Jonen (CH); Myrta Kappeler, Muri (CH); Felix Meili, Wettawil (CH)

(73) Assignee: Hawa AG, Mettmenstetten (CH)

( * ) Notice: Subject to any disclaimer, the term of this patent is extended or adjusted under 35 U.S.C. 154(b) by 0 days.

(21) Appl. No.: 14/297,003

(22) Filed: Jun. 5, 2014

(65) Prior Publication Data

US 2015/0026928 A1 Jan. 29, 2015

(30) Foreign Application Priority Data

Jul. 26, 2013 (EP) ..... 13178194

(51) Int. Cl.
*A47H 15/00* (2006.01)
*E05D 15/16* (2006.01)
(Continued)

(52) U.S. Cl.
CPC ..... *E05D 15/0621* (2013.01); *E05D 15/0634* (2013.01); *E05Y 2900/142* (2013.01); *E05F 5/003* (2013.01); *E05Y 2201/412* (2013.01)

(58) Field of Classification Search
CPC ..... E05Y 2900/132; E05Y 2201/64; E05Y 2201/412; E05F 1/08; E05F 1/16; E05F 3/00; E05F 3/02; E05F 3/04; E05F 3/18; E05F 5/00; E05F 5/003; E05D 15/0634; E05D 15/0639; E05D 15/0626; E05D 15/0652; E05D 15/0621; E05D 15/0669; E05D 15/0673
USPC ..... 16/49, 71, 86 B, 70, 72, 80, 85, DIG. 10, 16/91, 94 R, 102, 106, 107; 49/404, 407, 49/386, 451, 454, 455, 409; 312/322, 312/332.1, 333, 334.44, 334.46, 319.1; 292/262, 266–270, 277, 173, 38, 292/DIG. 46; 160/199, 196.1, 206
See application file for complete search history.

(56) References Cited

U.S. PATENT DOCUMENTS 2,277,316 A * 3/1942 Garrison ..... 292/274
3,630,560 A * 12/1971 Atkins et al. ..... 292/270
(Continued)

FOREIGN PATENT DOCUMENTS

EP 2 151 538 A1 2/2010
EP 2 217 782 B1 8/2010
(Continued)

OTHER PUBLICATIONS

Extended European Search Report issued in European Application No. 13178194.0 issued Nov. 22, 2013 (with translation).

*Primary Examiner* — Chuck Mah
(74) *Attorney, Agent, or Firm* — Oliff PLC

(57) ABSTRACT

A carriage, which serves for holding and shifting a separating element in a running direction along a rail, includes a carriage body that holds at least one running element and a mounting body that is slidably connected to the carriage body and is connectable to the separating element. A coupling member includes a first and second coupling element connected via a bridge member, wherein the first coupling element is slidably held in the carriage body and the second is slidably held in the mounting body. The bridge member has a first coupling surface inclined relative to the running direction which supports the carriage body or the mounting body, so that with a movement of the coupling member the carriage and mounting bodies are shifted relative to one another. The shifting device includes two inventive carriages that are guided in a rail and that are connected to a separating element.

15 Claims, 13 Drawing Sheets

(51) Int. Cl.
*E05D 15/06* (2006.01)
*E05F 5/00* (2006.01)

(56) References Cited

U.S. PATENT DOCUMENTS

| | | | | |
|---|---|---|---|---|
| 5,450,693 | A * | 9/1995 | Tarrega | 49/411 |
| 6,021,547 | A * | 2/2000 | Stagoll | 16/105 |
| 6,052,867 | A * | 4/2000 | Haab et al. | 16/87.6 R |
| 6,418,588 | B1 * | 7/2002 | Haab et al. | 16/91 |
| 7,891,052 | B2 | 2/2011 | Haab et al. | |
| 8,307,497 | B2 * | 11/2012 | Chang et al. | 16/71 |
| 8,393,114 | B2 | 3/2013 | Haab et al. | |
| 8,522,398 | B2 | 9/2013 | Haab et al. | |
| 2004/0237252 | A1 * | 12/2004 | Hoshide et al. | 16/72 |
| 2009/0100760 | A1 * | 4/2009 | Ewing | 49/410 |
| 2010/0031577 | A1 | 2/2010 | Haab et al. | |
| 2010/0123378 | A1 * | 5/2010 | Chen et al. | 312/333 |
| 2010/0139038 | A1 * | 6/2010 | Busch | 16/90 |
| 2010/0205772 | A1 * | 8/2010 | Haab et al. | 16/91 |
| 2010/0269291 | A1 * | 10/2010 | Haab et al. | 16/91 |
| 2010/0270898 | A1 | 10/2010 | Haab et al. | |
| 2011/0023370 | A1 * | 2/2011 | Zimmer et al. | 49/360 |
| 2011/0067313 | A1 * | 3/2011 | Walhorn | 49/360 |
| 2011/0167588 | A1 * | 7/2011 | Chang et al. | 16/71 |
| 2011/0203075 | A1 * | 8/2011 | Iwaki | 16/49 |
| 2013/0019438 | A1 * | 1/2013 | Tanno et al. | 16/94 R |
| 2013/0091665 | A1 * | 4/2013 | Tsai | 16/49 |
| 2013/0160240 | A1 * | 6/2013 | Kenny | 16/89 |
| 2013/0219657 | A1 * | 8/2013 | Iwaki | 16/64 |
| 2014/0026357 | A1 * | 1/2014 | Zimmer et al. | 16/72 |
| 2014/0143980 | A1 * | 5/2014 | Chang et al. | 16/91 |

FOREIGN PATENT DOCUMENTS

| | | | |
|---|---|---|---|
| EP | 2 248 976 | A1 | 11/2010 |
| EP | 2325424 | A2 * | 5/2011 |
| FR | 2 903 446 | A1 | 1/2008 |
| WO | WO 2006011294 | A1 * | 2/2006 |

* cited by examiner

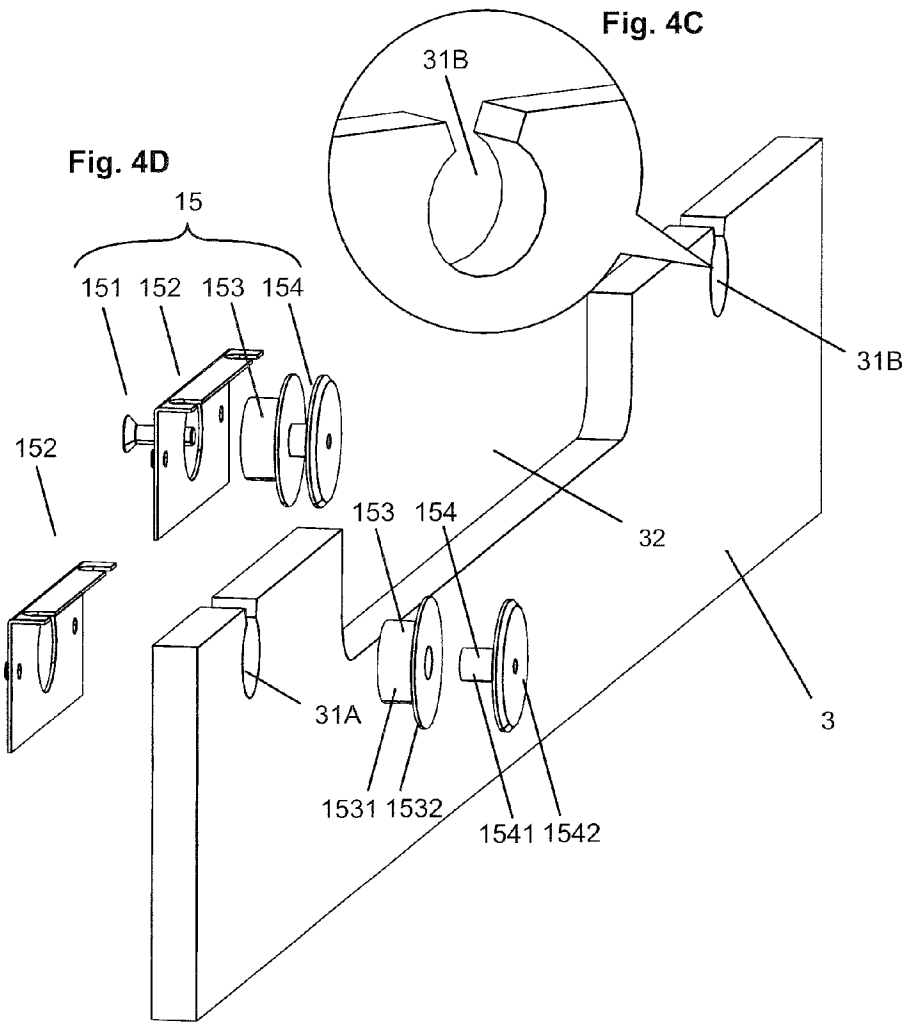
Fig. 4C
Fig. 4D
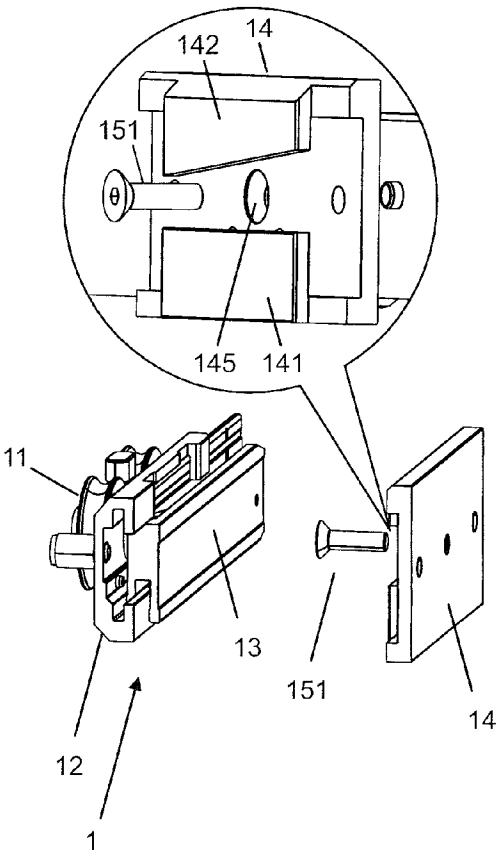
Fig. 4B
Fig. 4A 12
14
120
121
122
123
124
128
140
141
142
1421
145
K1
K2
K3

58B
54B
51
57A
5701
570

562
61
6A
561
563
56A
567
570
5B
54B
57A
51
55B
56A
6A
5A
55A
50B
50A
54A
56B 551
565
562
56B
561
563
567
54B
564
54A
58A 61
6B

ADJUSTABLE CARRIAGE AND SHIFTING DEVICE

BACKGROUND OF THE INVENTION

The invention relates to an adjustable carriage, which serves for holding a plate-shaped separating element, e.g. a glass plate, and to a shifting device preferably comprising two of these carriages that are movably supported by a rail and that hold the separating element.

An adjustable carriage, which serves for holding a separating element in a selectable height as well as a shifting device with such carriages, are known from [1], U.S. Pat. No. 7,891,052B2. These carriages comprise a mounting body, which can be mounted laterally at the upper edge of the separating element and which comprises a guide profile with an inclined guide surface. A carriage body that is provided with running wheels can be inserted into the guide profile in such a way that it can be shifted along the inclined guide surface. Hence, by shifting the carriage body the separating element held can be adjusted in height. However, it is disadvantageous that the carriage body is not only shifted vertically but also horizontally, i.e. into the running direction, when the carriage is adjusted.

A movement of the carriage body causes undesirable side effects. If a buffer device is installed, which serves as an end stop for the separating element and which is contacted at this end stop by the carriage body, then an undesirable shift of the separating element relative to the end stop results when the carriage is adjusted. In order to hold the separating element after the adjustment of the carriage at the same position at an end stop, the buffer device must be shifted along the rail over a distance that corresponds to the shift of the carriage body, caused by the adjustment. Further, after a shift of the carriage body an undesirable torque can act in the coupling range onto the separating element. In the range of a mounting bore that is provided in separating element for receiving a connecting device, critical tensions can occur in the material.

In known carriages it is further disadvantageous that they can get released from elements of the rail, if strong forces fitfully act on the separating element.

SUMMARY OF THE INVENTION

The present invention is therefore based on the object of further improving known adjustable carriages and the corresponding shifting device.

In particular, a carriage with a simple design shall be created that comprises a carriage body and running elements attached thereto, with which a separating element, such as a glass plate, shall be adjustable in height, without the occurrence of a shift of the carriage body in running direction.

By means of the inventive carriage, the separating element shall be adjustable in height and horizontally alignable without the requirement of readjusting further device elements and without the occurrence of disturbing torques, which act on the separating element or the connecting device.

The carriage shall be built with a compact form and shall allow entering the upper side of the separating element into the cross-section of the rail.

Further, the carriage shall be designed in such a way that it can safely be guided along the rail.

Still further, an advantageous shifting device shall be defined, which is equipped with at least one of the inventive carriages.

In a preferred embodiment, the shifting device shall be provided with a retraction device that allows pulling the separating element not only in one direction in to a first end position, but into the one and the other direction into the first and second end position. It shall advantageously be possible to combine the retraction device with the carriage and the separating element, so that a minimum amount of space is taken and an enlargement of the cross-section of the rail can be avoided. As required by the user, it shall be possible to use the same shifting device with or without retraction device.

Thereby, the shifting device shall be designed in such a way, that the retraction device can be operated independently of the present adjustment of the carriages.

The carriage, which serves for holding and shifting a separating element in a running direction along a rail, comprises a carriage body, which holds at least one running element and a mounting body that is slidably connected to the carriage body and that is connectable to the separating element.

According to the invention, a coupling member is provided, that comprises a first and a second coupling element that are connected with one another via a bridge member, wherein the first coupling element is slidably held in the carriage body and the second coupling element is slidably held in the mounting body. The bridge member has a first coupling surface that is inclined relative to the running direction and that supports the carriage body or the mounting body, so that with a movement of the coupling element the carriage body and the mounting body are shifted relative to one another.

The shifting device comprises two inventive carriages that are guided in a rail and that are connected to a separating element, preferably a glass plate, and of which carriages preferably one is releasably connected to a retraction device.

The carriages are mounted laterally at the upper edge of the separating element and do not or only slightly overlap the separating element. Hence, the separating element can extend into the cross-section of the rail. Hence, if in preferred embodiments the rail is inserted into the ceiling, then the upper edge of the separating element extends as well into the ceiling. Consequently, it is an advantage that covering the transition range between the rail and the separating element is not required. Only in preferred embodiments additional elements, such as cover profiles or bezels are provided.

It is particularly advantageous that for adjusting the height of the separating element only the coupling member needs to be moved, while the carriage body remains held stationary and the mounting body is vertically shifted only as required. After the adjustment of the carriages, i.e. after the horizontal alignment of the separating element on a desired height, the position of the carriages along the rail remains unchanged. Unchanged is also the distance between the carriages and the buffer devices, which are mounted inside the rail preferably at both ends. Hence, after coupling the newly adjusted carriage to the related buffer device, the vertical front edge and the vertical rear edge of the separating element exhibit unchanged the same distance to the edge of the room opening or towards a lateral terminating profile. The installer can adjust the height of the separating element without the need of subsequently shifting the buffer device.

In order to avoid readjustment of the buffer devices, the carriage body and the mounting body are supported in such a way that they are vertically movable against one another. The coupling member is shiftable preferably in parallel to the running direction of the carriages.

Since any shift of the carriage body relative to the mounting body is avoided, the line along which the load is transferred from the separating element to the carriage remains unchanged. Hence, the inventive carriage can be connected to the separating element and can be adjusted as desired without the occurrence of torque acting on the separating element or the connecting device.

In order to obtain a reduced broadness of the carriages, plate-shaped first and second coupling elements are provided. These plate-shaped coupling elements can be held in a simple manner, if the carriage body and the mounting body are provided with one or a plurality of C-profile shaped sections, which engage, interlinked into one another, and which are laterally held and vertically shiftable against one another.

Preferably two C-profile shaped sections of the carriage body delimit a first bearing channel, in which the first coupling element the coupling element is slidably held. Preferably, only one C-profile shaped section of the mounting body delimits a second bearing channel, in which the second coupling element of the coupling element is slidably held. The end pieces of the C-profile shaped sections the carriage body and the C-profile shaped sections of the mounting body which are facing one another and which serve as holding elements, preferably lie besides one another without extending into the neighbouring bearing channel.

Preferably, the holding elements, i.e. the end pieces of the C-profile shaped sections of the carriage body and the mounting body form on both sides each a common first and second plane, which delimit partially the first respective the second bearing channel.

The end pieces of the C-profile shaped sections of the carriage body and the mounting body, which are facing one another, delimit below and above a third bearing channel, in which the bridge member of the coupling element is slidably. Laterally the bridge member is immovable, because the coupling elements of the coupling element are guided in the first and second bearing channel preferably with little lateral play only.

The end pieces of the C-profile shaped sections of the carriage body and the mounting body, which are facing one another, lie laterally with little play besides one another, so that these end pieces and consequently the carriage body and the mounting body can only be shifted in one direction relative to one another, which extends preferably perpendicular to the running direction of the carriages or perpendicular to the longitudinal axis of the rail.

If one of the holding elements, i.e. one of the end pieces of the C-profile shaped sections of the carriage body and the mounting body extends into the third bearing channel, then this end piece is seated on the bridge member and is vertically shifted within the third bearing channel when the coupling element is moved. Consequently, together with this holding element or end piece also the carriage body connected thereto or the mounting body connected thereto is shifted.

The bridge member and the therewith interacting holding element, i.e. the end piece of the C-profile shaped section preferably comprise plain contact surfaces, which are inclined for example by an angle in the range from 15° to 45° relative to the longitudinal axis of the rail. The length and inclination of the contact surfaces are selected with regard to the adjustment range, which lies typically within the range of +/−10 mm. E.g., an adjustment range of +/−3 mm may be selected. With an inclination of 15° adjustments can precisely be done with little effort.

The carriage body or the mounting body, which is vertically shifted by the bridge member when the coupling element is moved, comprises a bearing channel, in which the related coupling element of the coupling member is laterally guided in a plane. However, below and above the coupling element the related bearing channel exhibits free space, so that the coupling element can be shifted vertically within the carriage body or within the mounting body, i.e. so that the carriage body or the mounting body can be shifted vertically relative to the coupling element.

The carriage body or the mounting body, which is not moved by the bridge member when the coupling member is shifted, preferably comprises a bearing channel, in which the related coupling element of the coupling member is held axially movable only. Preferably the coupling member is axially shiftable held by the carriage body, while the mounting body is shiftable vertically to the running direction relative to the carriage body and the coupling member. Below and in the detailed description only this embodiment is further described. However, kinematic reversal is possible.

In a further preferred embodiment, the carriage body is provided in addition with an upper running element, which is guided along an upper rail element. The upper and the lower rail elements are preferably arranged vertically above one another in a side member of the rail and delimit a running- and guiding channel, in which lower and upper running elements of a carriage can be guided. Hence, the carriage is guided below and above by the lower and upper rail elements and is safely held in the running- and guide channel. It is thereby prevented that if a stroke hits the separating element and the carriage body, that the running elements, e.g. the track rollers, can get released from the lower rail element.

The lower rail element exhibits at its upper side preferably a roller track, on which the track rollers of the carriage can be guided. The upper rail element forms at its lower side preferably a guide track, along which a gliding element is guided that is provided at the upper side of a guide element provided on the carriage body.

Hence, the carriage is preferably held both sided, below and above with running elements, track rollers and/or gliding elements, which are guided along a lower and a upper rail element and which safely guide the carriage if forces vertically act on the separating element.

Inventive carriages can be installed in various devices, with which a separating element, particularly a glass plate, can be shifted. In order to limit the running distance of the separating element as desired and to fix the separating element in an end position, buffer devices are preferably provided, with which the related carriages can be coupled. For this purpose, the buffer devices preferably comprise a holding spring that can be coupled with a buffer element; e.g. a bolt that can be inserted vertically aligned to the running direction into the carriage body.

The shifting device preferably comprises a retraction device, which is releasably coupled with one of the carriages and which is preferably arranged within a recess provided in the separating element. The retraction device comprises at least one retraction unit, with which the separating element can automatically be driven into an end position. Each retraction unit comprises a retraction spring and a retraction damper, a preferably dual sided guide slideway and a locking unit.

The locking unit comprises a) a first holding member for holding and tensioning the retraction spring;
b) a second holding member for holding a plunger that serves for actuating the retraction damper;
c) two guide cams that can be guided in tracks of the guide slideway into a locking range; and
d) at least one lever part that can be actuated by a stationary mounted stop member when it is moved along the rail.

When pulling the separating element away from the end position, the locking unit, which has been catched by the stop member is guided along the slideway track into the locking range and held locked there. Thereby the retraction spring is tensioned and held in tensioned state even after the stop member has released the locking unit. When travelling back the locking unit is catched again by the stop member and is turned back out of the locking range, so that the retraction spring is released and can use the stored energy for driving the separating element into the end position. This process is opposed by the retraction damper, which comprises a plunger that is connected to the locking unit.

A retraction device that is releasably connected to a carriage, is known from [2], publication EP2217782B1. This retraction device comprises only one retraction unit arranged within the rail and uses the space of the cross-section of the rail completely. Hence, the separating element is arranged below the rail. According to the invention, this solution has advantageously been improved. Surprisingly, co-existence of the separating element and the retraction device within the cross-section of the rail could be reached, so that an extremely compact shifting device could be realised.

In a preferred embodiment, a first and a second retraction unit have advantageously been integrated into the retraction device. The two retraction units are arranged each in a chamber of the retraction device. The device chambers are separated from one another by a functional housing, which functional housing comprises on one side a first housing member that serves for receiving the first retraction unit and that can be covered by a first housing cover, and which functional housing comprises on the opposite side a second housing member that serves for receiving the second retraction unit and that can be covered by a second housing cover.

The first housing member and the first housing cover as well as the second housing member and the second housing cover each comprise tracks with a locking section, which correspond to one another. The locking unit is guided bilaterally with guide cams, which are preferably axially aligned relative to one another, along the tracks into the locking section.

The first and the second retraction unit are arranged above one another and are assigned to a first and a second stop member, which are connected to the rail at correspondingly selected positions along the rail. Preferably the first and the second stop member are formed identically and comprise in one half a stop element. The identical stop members can be mounted in the rail in such a way that the stop elements extend into the cross-section of the rail in ranges offset from one another. Hence, the stop element of the first stop member and the stop element the second stop member are mounted vertically displaced.

The stop elements are designed in such a way that they can engage with the related locking unit independently of the selected adjustment of the carriages. The lever elements of the locking units can be vertically shifted along the stop elements within the adjusting range of the carriages and remain always within the engagement range.

The inventive retraction device can be integrated into the shifting device without enlarging the cross-section of the rail. The carriages can be adjusted without readjusting the inventive retraction device.

The retraction device further allows traction of the separating element into the first and into the second end position. A second retraction device used for the second carriage is not required. Principally, the shifting device with the inventive integration of the retraction device can also be used with different carriages that are mounted at the upper edge of a separating element and that comprise a mounting body, which can be connected to the retraction device. A limitation to carriages having the inventive functionality for height adjustment is not required.

Inventive carriages can ideally be used in combination with the inventive retraction device. Inventive carriages have a simple structure, require little space and allow advantageously performing height adjustment and horizontal alignment of the separating element. The carriage body of the inventive carriages can exhibit different forms that are adapted to the implemented running elements or combinations of running elements. The carriage body is preferably provided with a mounting shaft, which pivotally holds a beam that is provided at each end with a roller shaft that holds a track roller. In this manner the load of the separating element is equally distributed onto both track rollers.

Furthermore, the inventive carriages can be provided with a drive device and a control device.

BRIEF DESCRIPTION OF THE DRAWINGS

Below, the invention is described in detail with reference to the drawings. Thereby show:

FIG. 4A the carriage 1A of FIG. 1A with the released mounting body 14 and elements of a connecting device 15, which are shown as a group in FIG. 4D;

FIG. 4B in detailed view the mounting body 14 of FIG. 4A;

FIG. 4C in detailed view the mounting opening 31B provided in the separating element 3 of FIG. 4A;

FIG. 4D the connecting device 15 of FIG. 4A with the advice elements 151, 152, 153 and 154 that are coaxially aligned with one another;

DETAILED DESCRIPTION OF THE PREFERRED EMBODIMENTS

Figure 1B:
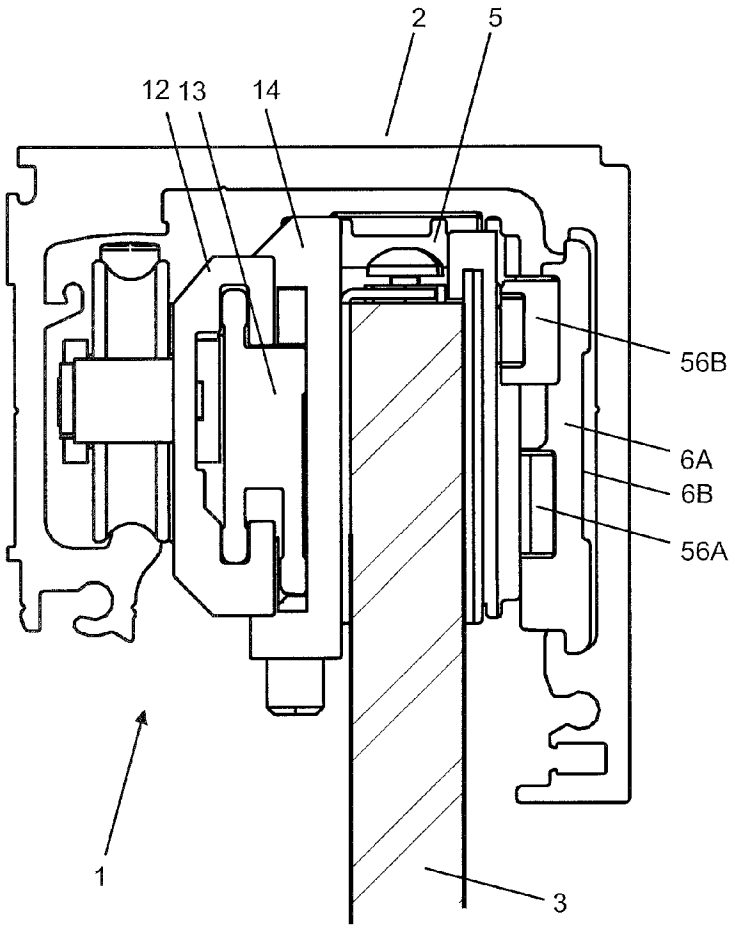
FIG. 1B the shifting device of FIG. 1A that is connected in addition to a retraction device 5, which interacts with stop members 6A, 6B that are mounted in the rail 2.
Figure 1A:
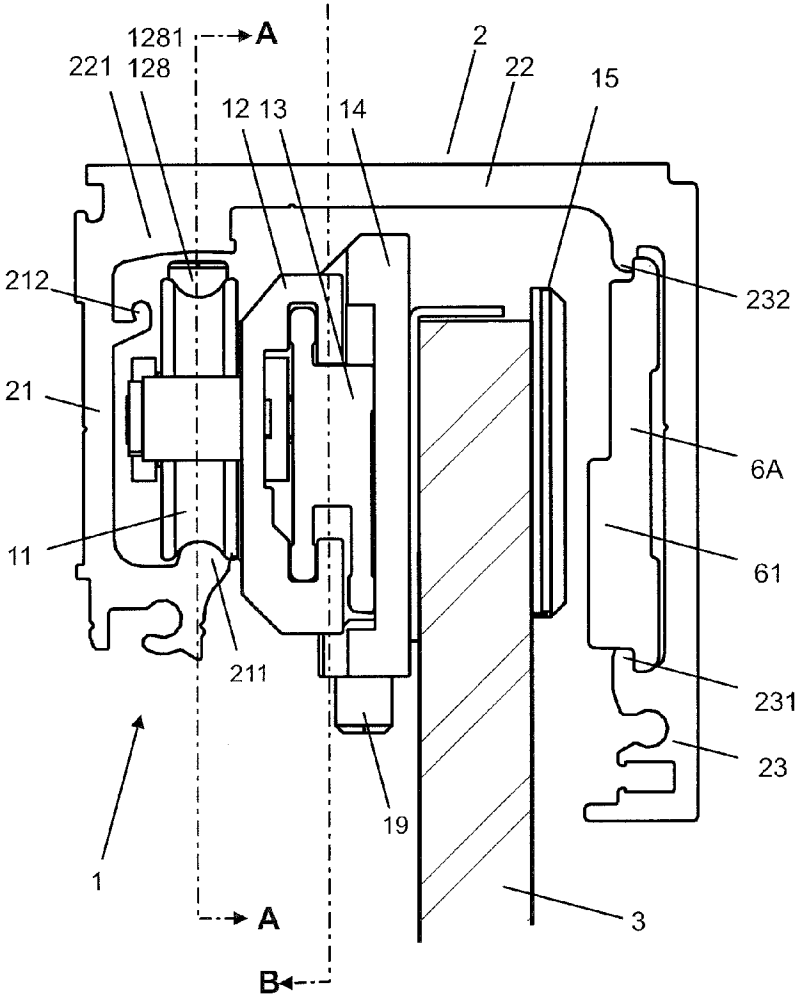
FIG. 1A a shifting device with an inventive carriage 1 that is guided in a rail 2 and that is mounted laterally at the upper edge of a separating element 3 as well as two cutting lines AA and BB.

FIG. 1A shows a shifting device with an inventive carriage 1 that is guided along a rail 2 and that is connected to a separating element 3, e.g. a glass plate.

The carriage 1, which is shown from the front side, comprises a carriage body 12, which holds on one side two track rollers 11 that are seated on a lower rail element 211 of the rail 2, and which is connected on the other side via a coupling member 13 with a mounting body 14. The mounting body 14 is mounted by means of a connecting device 15 laterally to the upper edge of the separating element 3.

Below it will be discussed in detail that the coupling member in this embodiment is supported in the carriage body 12 slidably in parallel to the running direction of the carriage 1, i.e. in parallel to the longitudinal axis of the rail 2 and that for a movement of the coupling member 13 a movement of the mounting body 14 results, which is held by the carriage body 12 slidable perpendicular to the longitudinal axis of the rail 2. The mounting body 14 is lifted by the coupling member 13, whereafter the coupling member 13 and the mounting body 14 are mutually fixed, preferably with two fixing elements 19, e.g. threaded bolts.

Figures 2A, 2B, 2C:
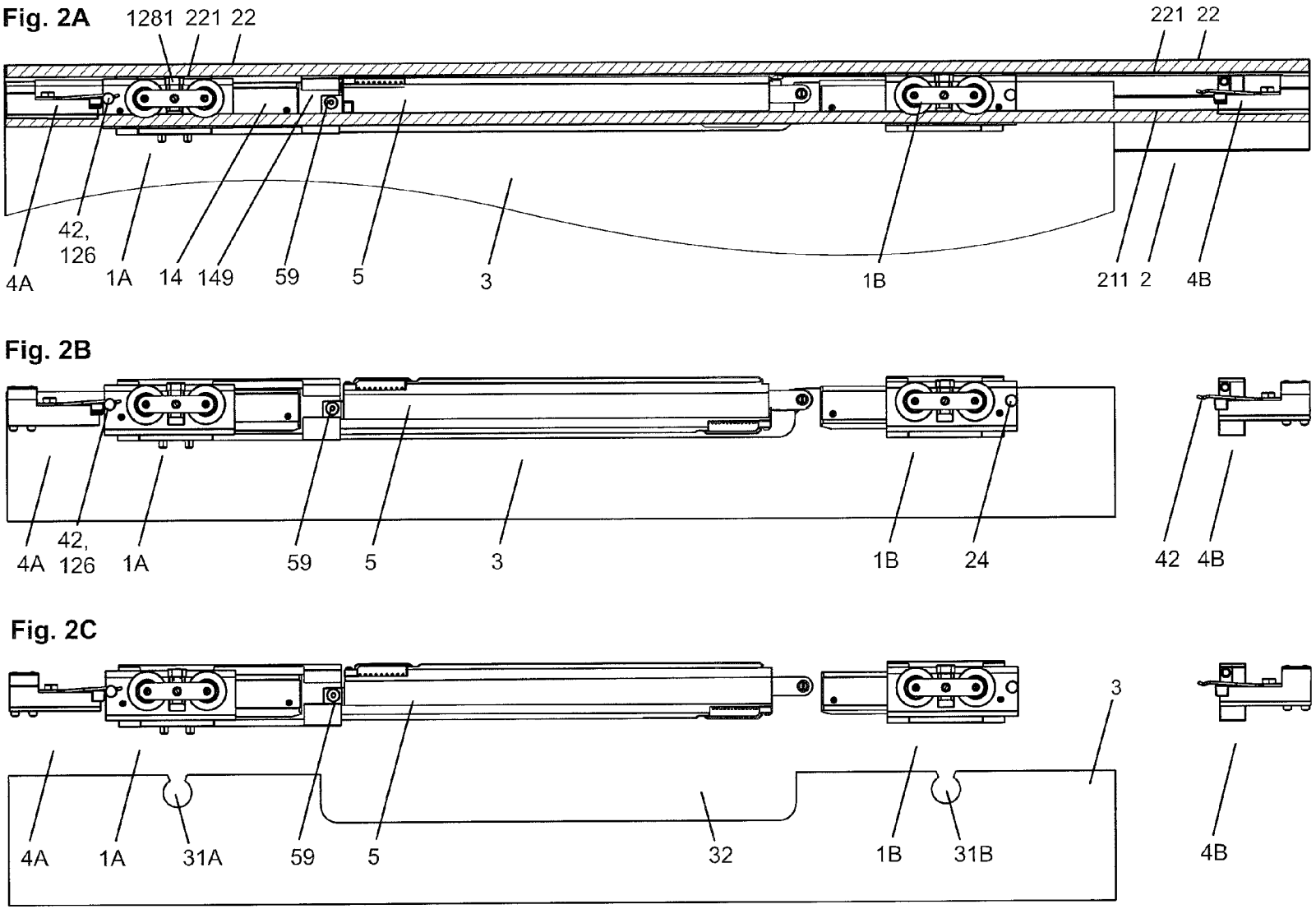
FIG. 2A the shifting device of FIG. 1B with two carriages 1A, 1B; the retraction device 5 and two buffer devices 4A, 4B that are held in the rail 2, which is cut along line AA shown in FIG. 1A.
FIG. 2B the shifting device of FIG. 2A without rail 2.
FIG. 2C the shifting device of FIG. 2B with the separating element 3, e.g. a glass plate, that is released from the carriages 1A, 1B, and that is provided with receiving openings 31A, 31B for mounting the carriages 1A, 1B as well as a recess 32 for receiving the retraction device 5.

The rail 2 is shown in a preferred embodiment and exhibits a U-profile that is opened downwards with a central member 22 and a first and second side member 21, 23. The first side member 21 comprises the lower rail element 211 as well as a profile element 212, which serves for holding buffer devices 4A, 4B that are inserted into the rail 2 as shown in FIG. 2A.

Figures 11A, 11B, 11C:
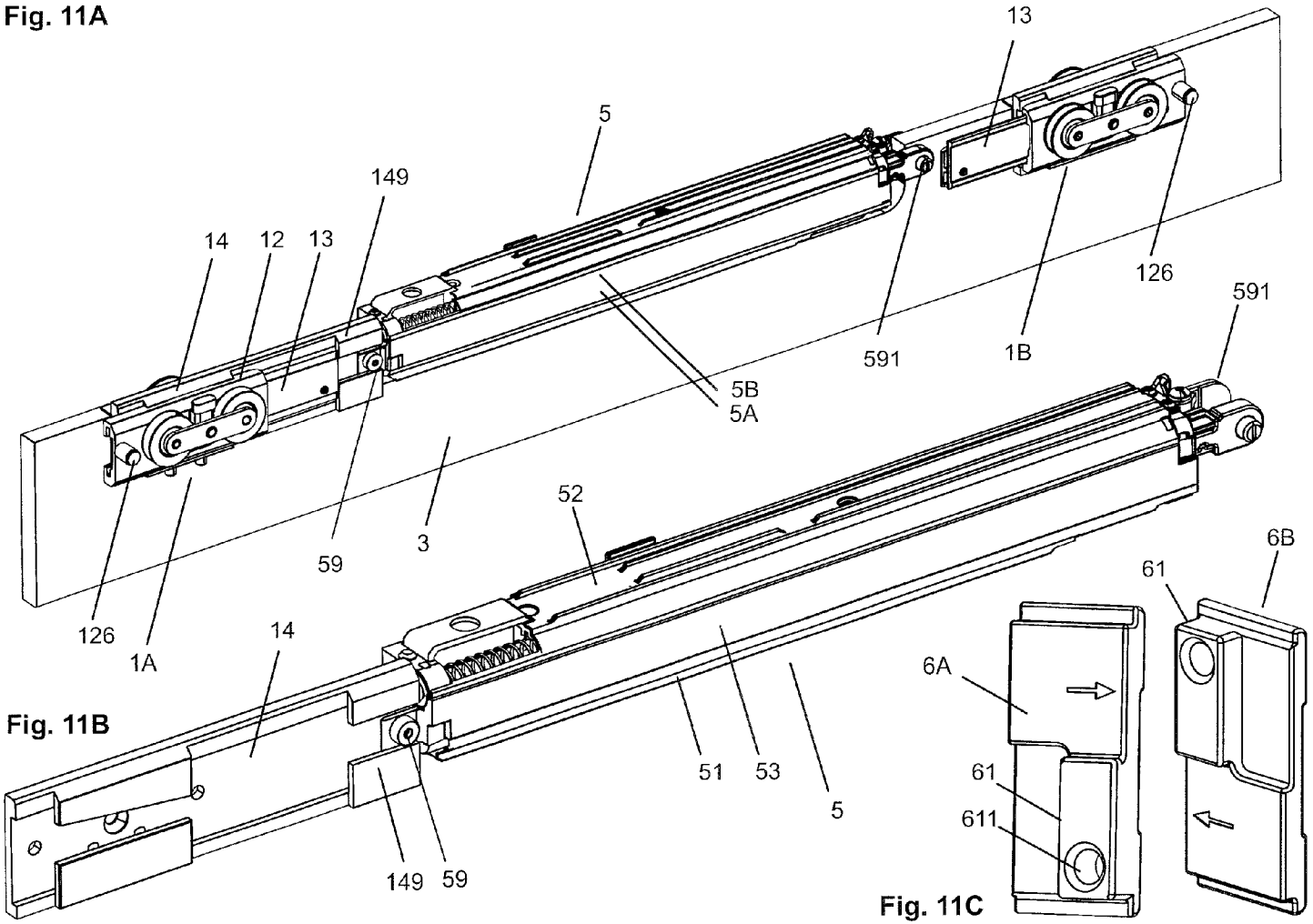
FIG. 11A the separating element 3 with both carriages 1A, 1B of FIG. 2A, of which the first carriage 1A, i.e. its mounting body 14 is connected to the retraction device 5, which preferably comprises two retraction units 5A, 5B arranged above one another.
FIG. 11B the retraction device 5 of FIG. 11A connected with a screw 59 to the mounting plate 14 of the carriage 1A.
FIG. 11C the stop members 6A and 6B of FIG. 1A and FIG. 13A in a mutual alignment, in which they are mounted in the rail 2.
Figure 12B:
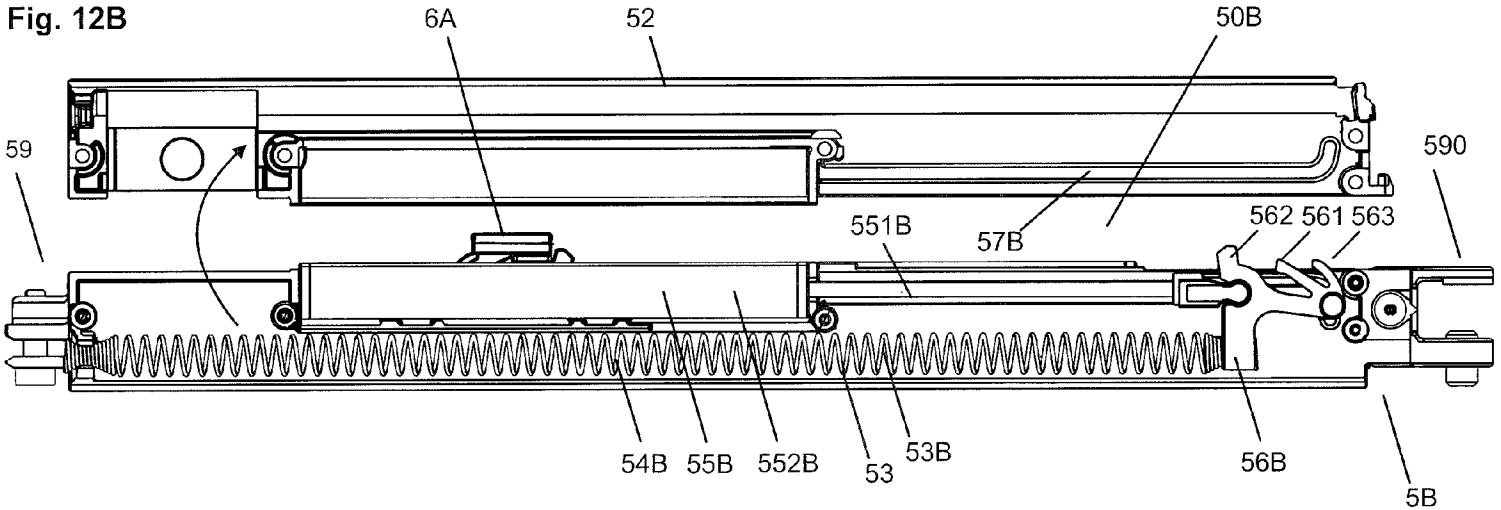
FIG. 12B the second retraction unit 5B of FIG. 11A with the housing 53 of the retraction device 5 as well as the upper housing cover 53 with both parts of a second guide slideway 57B, along which a second locking unit 56B is guided, which holds a second retraction spring 54B that is shown in a state under tension.
Figure 12A:
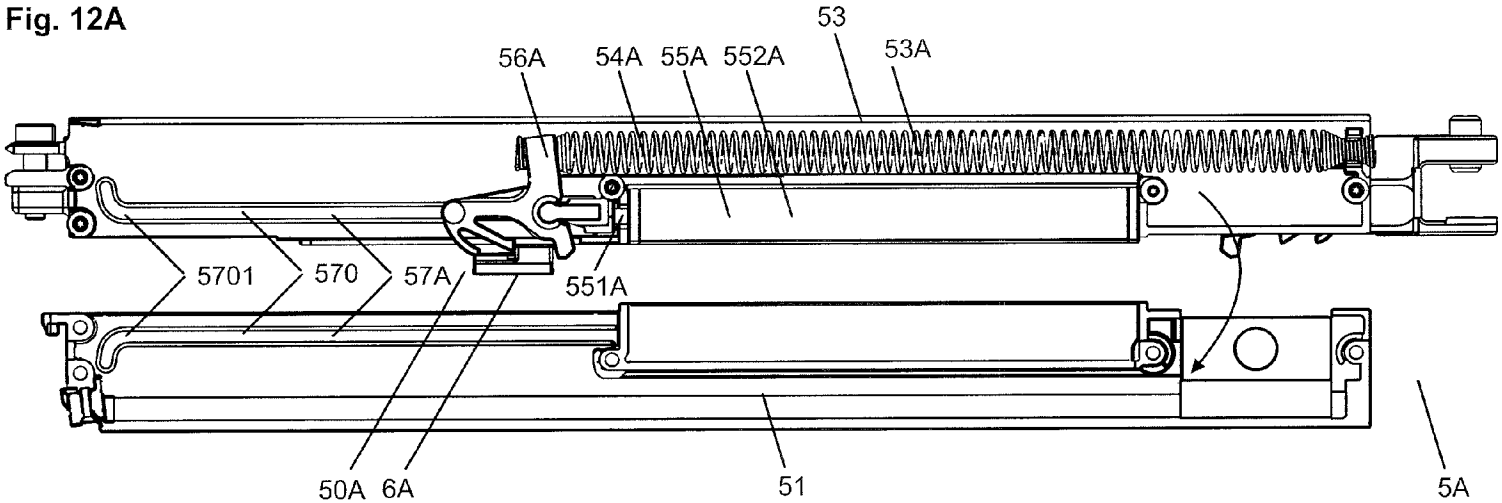
FIG. 12A the first retraction unit 5A of FIG. 11A with the housing 53 of the retraction device 5 as well as the lower housing cover 51 with both parts of a first guide slideway 57A, along which a first locking unit 56A is guided, which holds a first retraction spring 54A that is shown in a state with released tension.
Figures 13A, 13B, 13C, 13D:
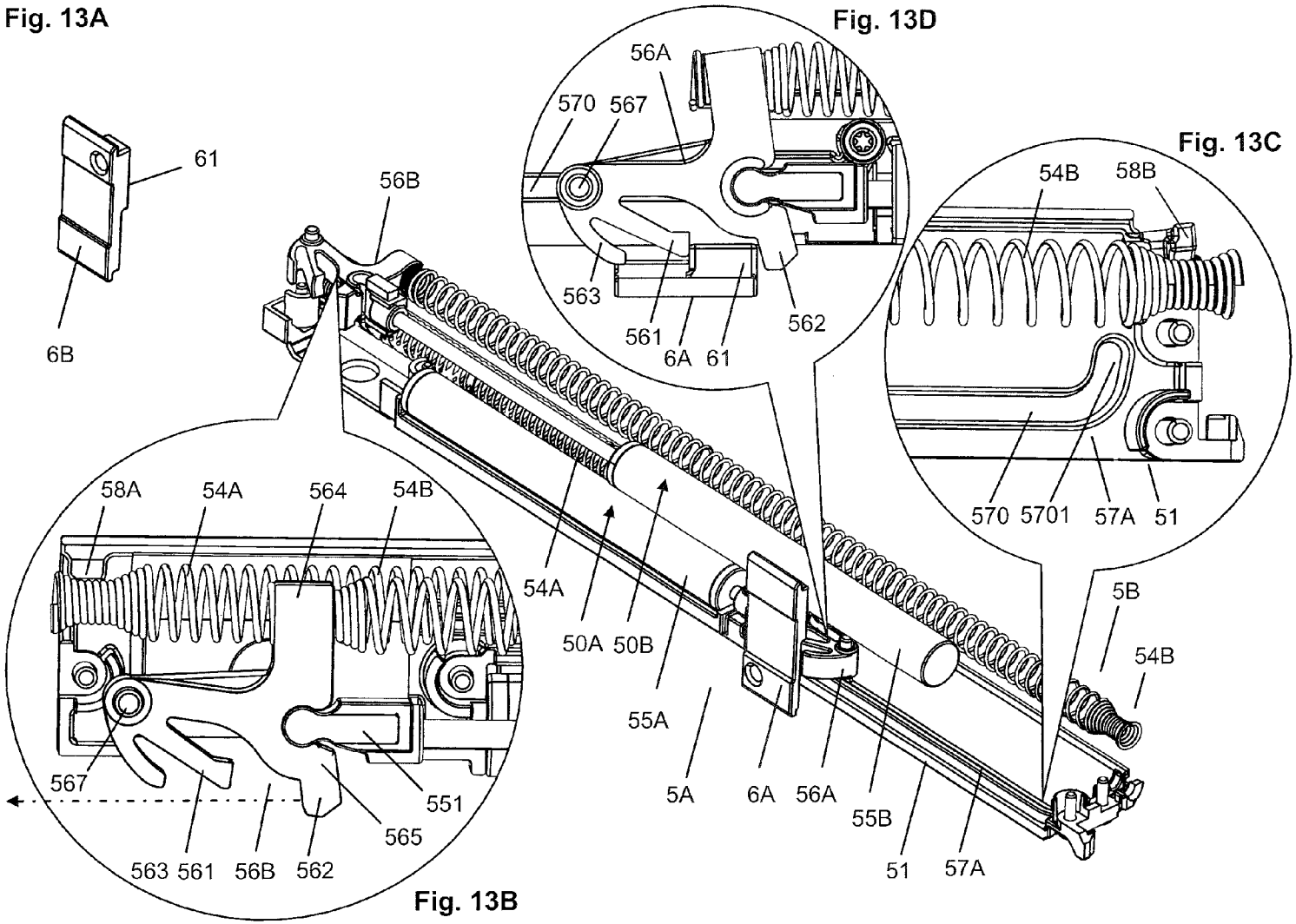
FIG. 13A the retraction device 5 of FIG. 11A after dismounting the housing 53 and the upper housing cover 52, with the lower housing cover 51 and the first locking unit 56A guided therein, which is coupled to the related first stop member 6A and with the second locking unit 56B, which is still far away from the related second stop member 6B.
FIG. 13B a detailed view of the second locking unit 56B of FIG. 13A, which holds the tensioned second retraction spring 54B.
FIG. 13C a detailed view of the end piece of the lower housing cover 51 of FIG. 13A with the lower slideway track 570 of the first guide slideway 57A extending into the locking range 5701.
FIG. 13D a detailed view of the first locking unit 56A of FIG. 13A, which is coupled to the first stop member 6A.

The second side member 23 comprises two additional profile elements 231, 232, which can hold the stop members 6A, 6B shown in FIG. 11C and FIG. 13A, which serve for actuating the retraction device 5 shown in FIG. 1B and FIG. 11A, which is not used in the embodiment of the shifting device of FIG. 1A. The plate-shaped stop members 6A, 6B are inserted behind the profile elements 231, 232 in parallel to the second side member 23 and are fixed e.g. with screws that are held in threaded bore 611 and that are preferably provided with a front sided cup point which is turned against the second side member 23. FIG. 1A shows a first stop member 6A having a stop element 61 in the lower half, which extends into the cross-section of the rail 2. FIG. 11C and FIG. 13A show that the second stop member 6B is inserted at the other end of the rail in such a way that the stop element 61 is located at the upper side. Hence, the first stop member 6A can actuate a first retraction unit 5A at one end of the rail 2 and the second stop member 6B can actuate a second retraction unit 5B at the other end of the rail. Hence, with the corresponding retraction units 5A, 5B, the separating element 3 can automatically be pulled in both end regions of the rail 2 towards the end stop. The retraction units 5A, 5B, which are preferably identical, are described below in detail with reference to FIGS. 12A, 12B and 13A.

Since the carriage 1 is guided on the lower rail element 211 of the first side member 21, the rail 2 can in principle be reduced to this side member 21, e.g. if the central member 22 is not required for mounting the rail 2 on the ceiling and the second side member 23 is not required for mounting the stop members 6A, 6B. The rail 2 can be reduced to the first side member 21 that is screwed for example to a building wall.

FIG. 1A further shows two cutting lines AA and BB. The first cutting line AA relates to a cut through the rail 2 shown in FIG. 2A. The second cutting line BB relates to a cut through the carriage body 12, the coupling member 13 and the mounting body 14 shown in FIGS. 10A and 10B.

Figures 5A, 5B, 5C:
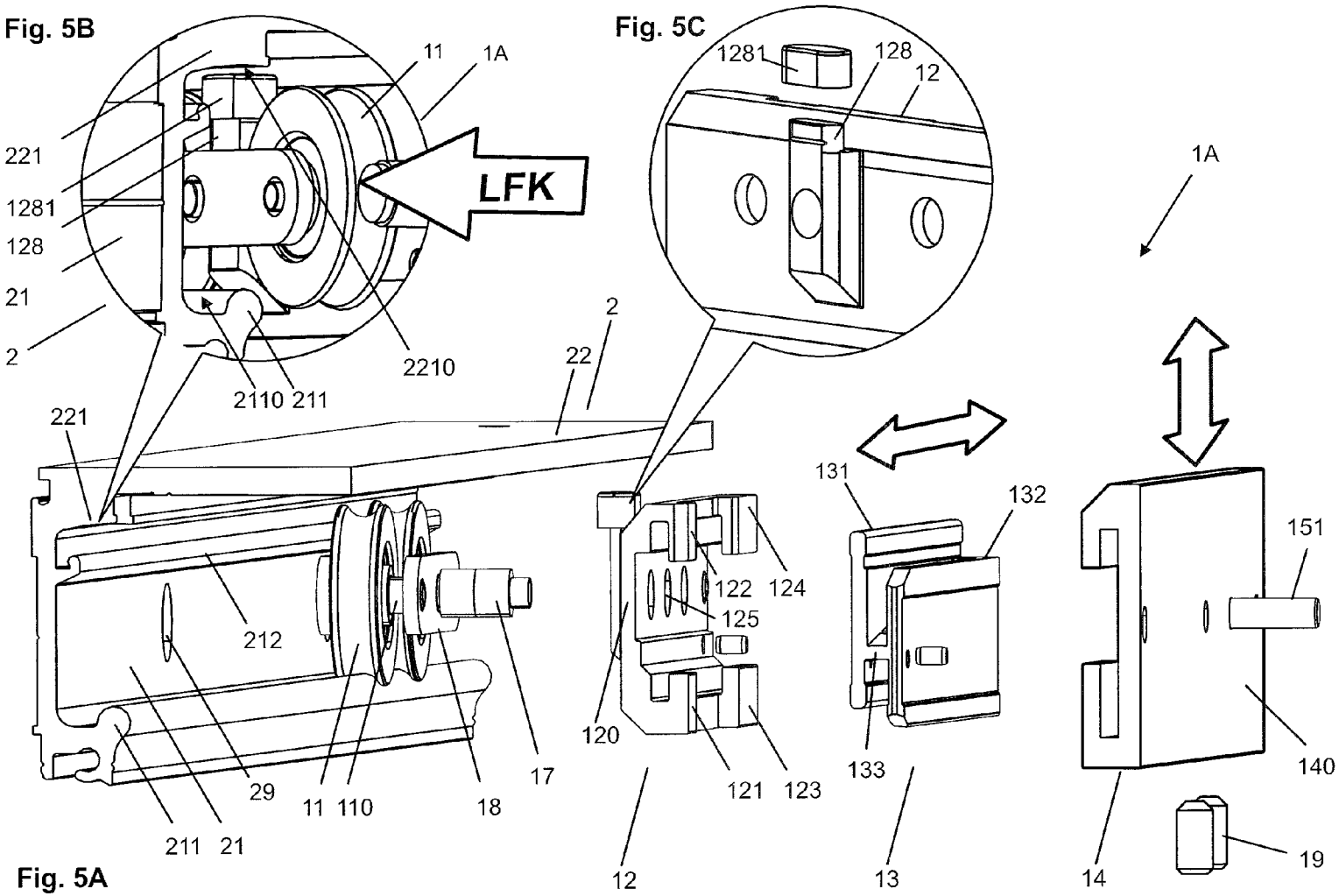
FIG. 5A the carriage 1A of FIG. 1A in explosion view with track rollers 11 guided on a lower rail element 211 of the rail 2, a carriage body 12, a coupling member 13 and a mounting body 14, into which a mounting screw 151 is inserted, with which the carriage 1A can be connected to the separating element 3.
FIG. 5B a detailed view of the rail 2 of FIG. 5A with an upper rail element 221 arranged above the lower rail element 211, along which a gliding element 1281 is guided which is mounted on a guide element 128 provided on the carriage body 12.
FIG. 5C a detailed view the guide element 128 of FIG. 5A onto which the gliding element 1281 is mounted.

FIG. 1A further shows that the rail 2 comprises an upper rail element 221 above the lower rail element 211. Hence, between the lower rail element 211 and the upper rail element 221 a running- and guide channel LFK is formed as shown in FIG. 5B. In the running- and guide channel LFK the running elements of the carriages 1A, 1B are guided. At the upper side of the lower rail element 211 a roller track 2110 is provided, along which the track rollers 11 of the carriages 1 are guided. At the lower side of the upper rail element 221 a guide track 2210 is provided, along which a gliding element 1281 is guided, which is seated as a kind of a hat on a guide element 128 that is connected to or formed on the carriage body 12.

FIG. 1A shows that the carriage 1 can therefore not be released from the lower rail element 211 by a vertical impact of force, a jerk or blow. For mounting and dismounting the carriage 1, the carriage body 12 is laterally inclined, so that the guide element 128 is released from the upper rail element 221 of the rail 2.

It is particularly advantageous that the mounting body 14 can first be connected to the separating element 3 and the carriage body 12, as shown in FIG. 1A, can be inserted into the rail, whereafter the carriage body 12 and the mounting body 14 are connected with one another in a simple manner by means of the coupling member 13. Hence, mounting and dismounting the carriage 1 and the shifting device is conveniently achieved with simple measures.

FIG. 1B shows the shifting device of FIG. 1A, which has been equipped in addition with a retraction device 5 that interacts with the stop members 6A, 6B held within the rail 2 as shown in FIGS. 1A and 11C. Advantageously the dimensions of the device parts, particularly the rail 2, remain unchanged after the installation of the retraction device 5. Within the rail 2 not only the upper end of the separating element 3, but also the retraction device 5 can be received, without increasing the cross-section of the rail 2. The retraction device 5 can advantageously interact with stop members 6A, 6B inserted in the second side member 23 the rail 2, which require little space as well.

FIG. 2A shows the shifting device of FIG. 1B with two carriages 1A, 1B, the retraction device 5 and two buffer devices 4A, 4B, which are held in the rail 2. The rail 2 is cut along line AA shown in FIG. 1A. The cut runs through the central member 22 and through the lower rail element 211, on which the carriages 1A, 1B are seated, and as well through the upper rail element 221 of the rail 2 located above.

FIG. 2A shows that the carriage 1A is supported below with the track rollers 11 on the rail element 211 and is guided above with the gliding element 1281, which is set up onto the guide element 128, along the upper rail element 221. In this preferred embodiment, the running elements 11 and the gliding element 1281 are located in the plane of the cut along line A-A. However, it is possible to use any running elements above and below, such as track rollers and gliding elements or combinations thereof and also to laterally offset them. However, the arrangement in a plane is particularly advantageous, since little space is used and mounting and dismounting the carriages 1A and 1B is not obstructed.

Figure 6B:
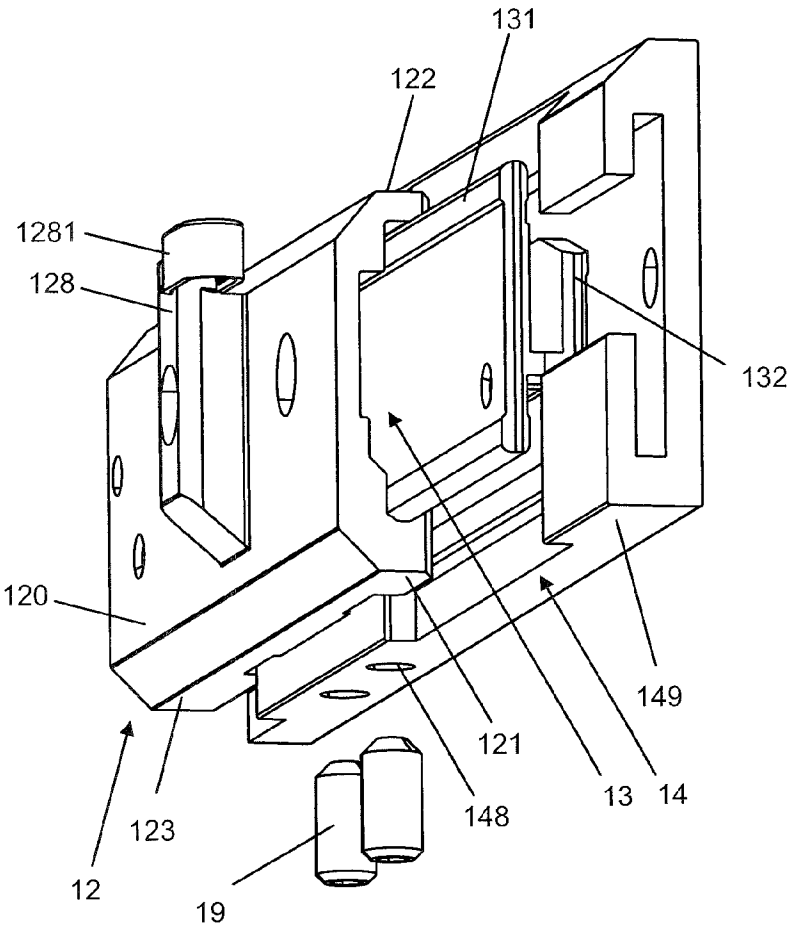
FIG. 6B the device parts 12, 13 and 14 of FIG. 6A as well as two fixing screws 19, with which the coupling member 13 can be fixed in a selected position.
Figure 6A:
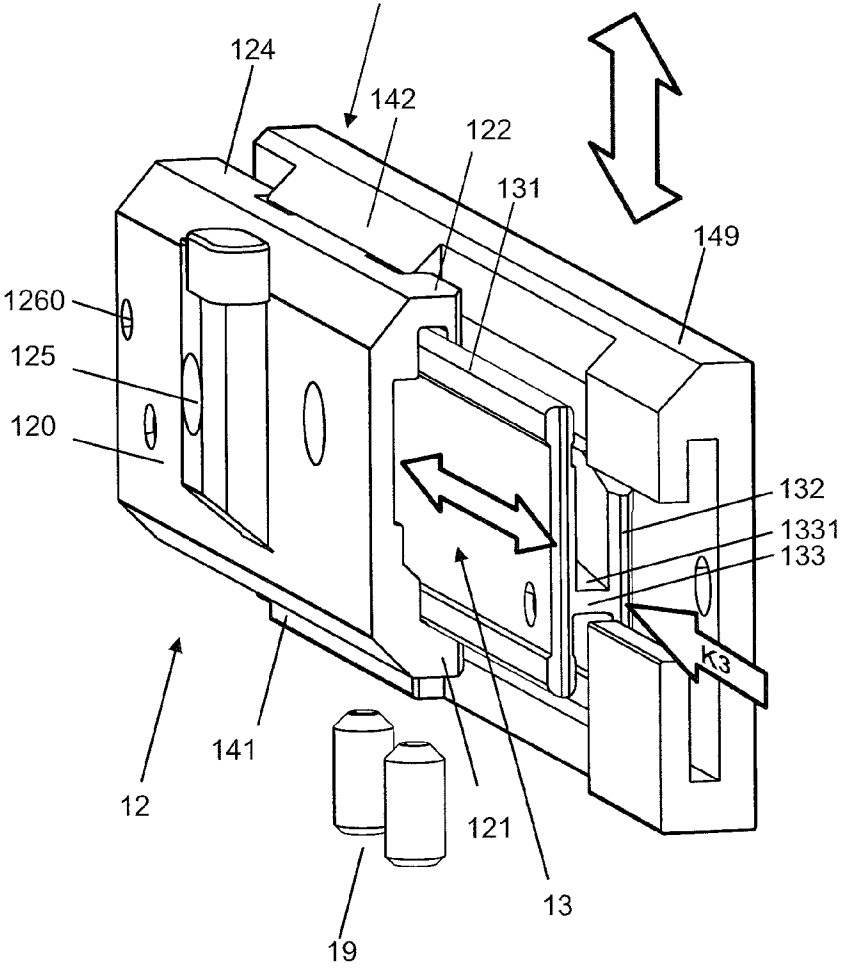
FIG. 6A the carriage body 12 and the mounting body 14 of the carriage 1A of FIG. 4A, which are connected with one another by means of the slidably supported coupling member 13.

The first carriage 1A is coupled to the first buffer device 4*a*, which comprises a holding spring 42, which is engaged with a buffer element 126, e.g. a bolt inserted in a mounting bore 1260 provided in the carriage body 12 (see FIG. 6A). The separating element 3 has reached the end stop and is aligned with the front edge flush with the end of the rail 2. The inventive carriages 1A, 1B allow adjusting the separating element 3 without the result of a moment of the separating element 3 in running direction. Hence, the separating element 3 can be shifted in height and can horizontally be aligned and remains at the same time stationary in running direction at a desired position within the rail 2.

The retraction device 5 is held by the first carriage 1A, that, in this preferred embodiment, comprises an extended mounting body 14 with a connecting element 149 that is releasably connected to a connecting member 59 of the retraction device 5. Hence, the retraction device 5 can be coupled to and decoupled from the first carriage 1A as desired.

In preferred embodiments unitary carriages 1 with identical mounting bodies 14 are used, which can be coupled to the retraction device 5.

FIG. 2B shows the shifting device of FIG. 2A without rail 2.

Figure 3:
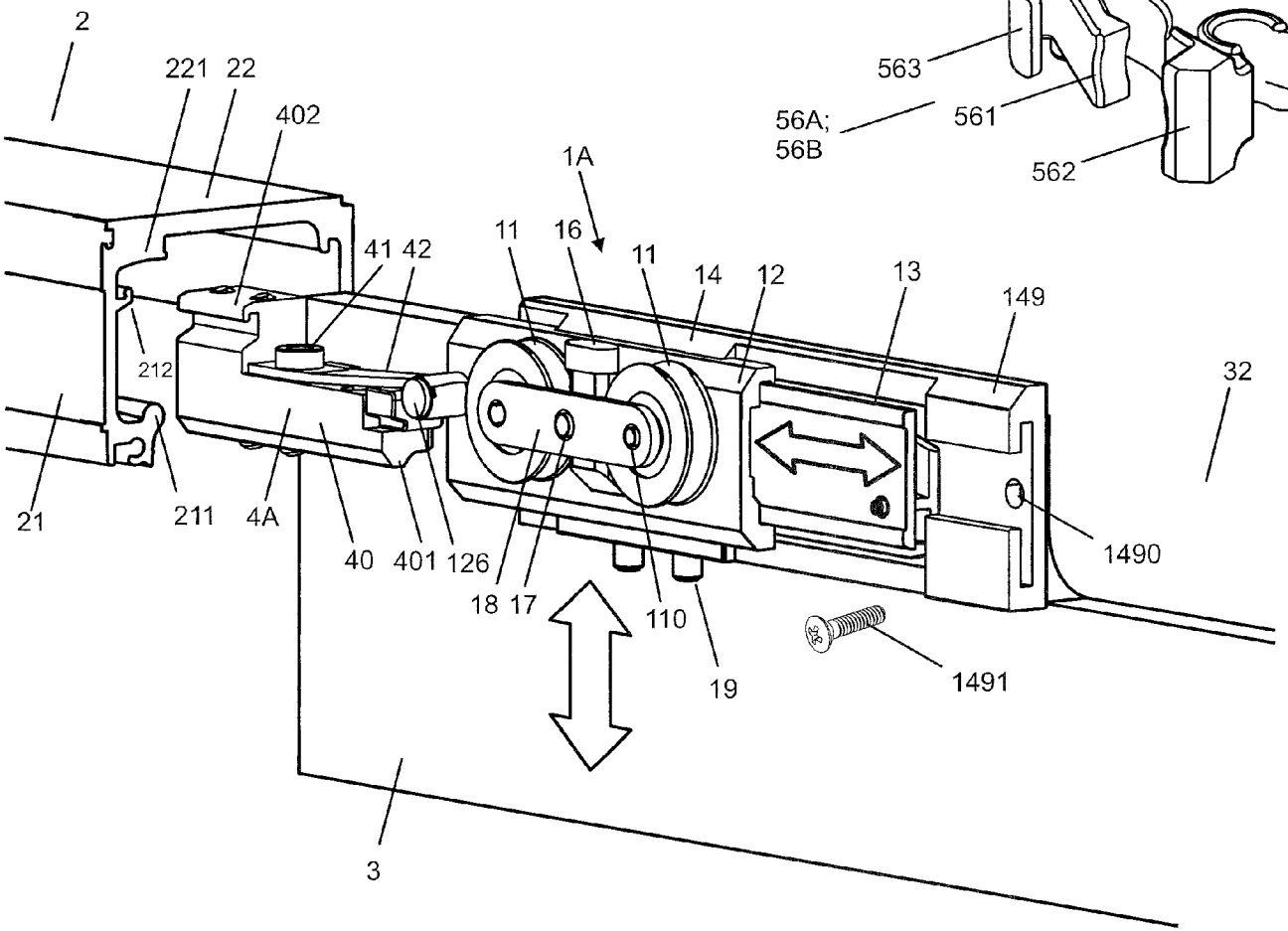
FIG. 3 in spatial view the first carriage 1A of FIG. 2A coupled to the first buffer device 4A.

FIG. 2C shows the shifting device of FIG. 2B with the separating element 3 released from the carriages 1A, 1B. The separating element 3 comprises two cylindrical mounting openings 31A, 31B for receiving the connecting devices 15 and an elongated recess 32 for receiving the retraction device 5. FIG. 3 shows in spatial view the first carriage 1A of FIG. 2A coupled to the first buffer device 4A. It is shown that the buffer device 4A comprises a buffer body 40 with a lower and an upper body member 401, 402, which can be held by the lower rail element 211 and the first profile element 212 of the first side member 21 of the rail 2.

The holding spring 42, which extends above the buffer element 126 inserted into the carriage body 12 and is engaged therewith, is fixed by means of a mounting screw 41 that is turned into the buffer body 40.

In addition a mounting shaft 17 is inserted in the carriage body 12, which pivotally holds a beam 18 in the middle. The beam 18 holds on both sides each a roller shaft 110 with a track roller 11. Hence, the load acting on the carriage 1A is equally distributed on to both track rollers 11.

FIG. 3 further shows that the mounting body 14 can vertically be shifted together the separating element 3 by horizontally moving the coupling member 13. It is further shown that the carriage 1A comprises an elongated mounting body 14 with a connecting element 149 that is provided with a mounting bore 1490. Hence, the retraction device 5 can be inserted into the recess 32 provided in the separating element 3 and be connected with the shown connecting screw 1491 to the mounting body 14.

FIG. 4A shows the carriage 1A of FIG. 1A with the released mounting body 14 and elements of the connecting device 15, which are shown as a group in FIG. 4D. The connecting device 15 comprises the mounting screw 151, a mounting angle 152, a mounting cylinder 153 and a mounting nut 154. The mounting angle 152 is placed at the upper edge of the separating element 3 and overlaps a lateral part and top part of the separating element 3. The mounting cylinder 153 comprises a cylinder element 1531, which can be inserted into the mounting bore 31A provided in the separating element 3, and which is adjoined by a cylinder flange 1532. The mounting nut 154 comprises a cylindrical threaded member 1541, which can be inserted into the mounting cylinder 151 and which is adjoined by a flange member 1542 that lies at the outer side of the mounting cylinder 153.

FIG. 4B shows in detailed view from the front side of the mounting body 14 of FIG. 4A having a mounting bore 145, into which the mounting screw 151 can be inserted.

FIG. 4C shows in detailed view the second mounting opening 31B provided in the separating element 3 of FIG. 4A.

FIG. 5A shows the carriage 1A of FIG. 1A in explosion view with the track rollers 11 guided on the lower rail element 211 of the rail 2, the carriage body 12, the coupling member 13 and the mounting body 14, into which the mounting screw 151 is inserted, with which the carriage 1A can be connected to the separating element 3. It is further shown that the carriage body 12 comprises a mounting bore 125, into which the mounting shaft 17 can be inserted that pivotally holds the beam 18 with the track rollers 11. Further shown is a mounting bore 29 provided in the first side member 21 of the rail 2, with which the rail 2 can be mounted on a building wall.

Figures 7A, 7B, 7C:
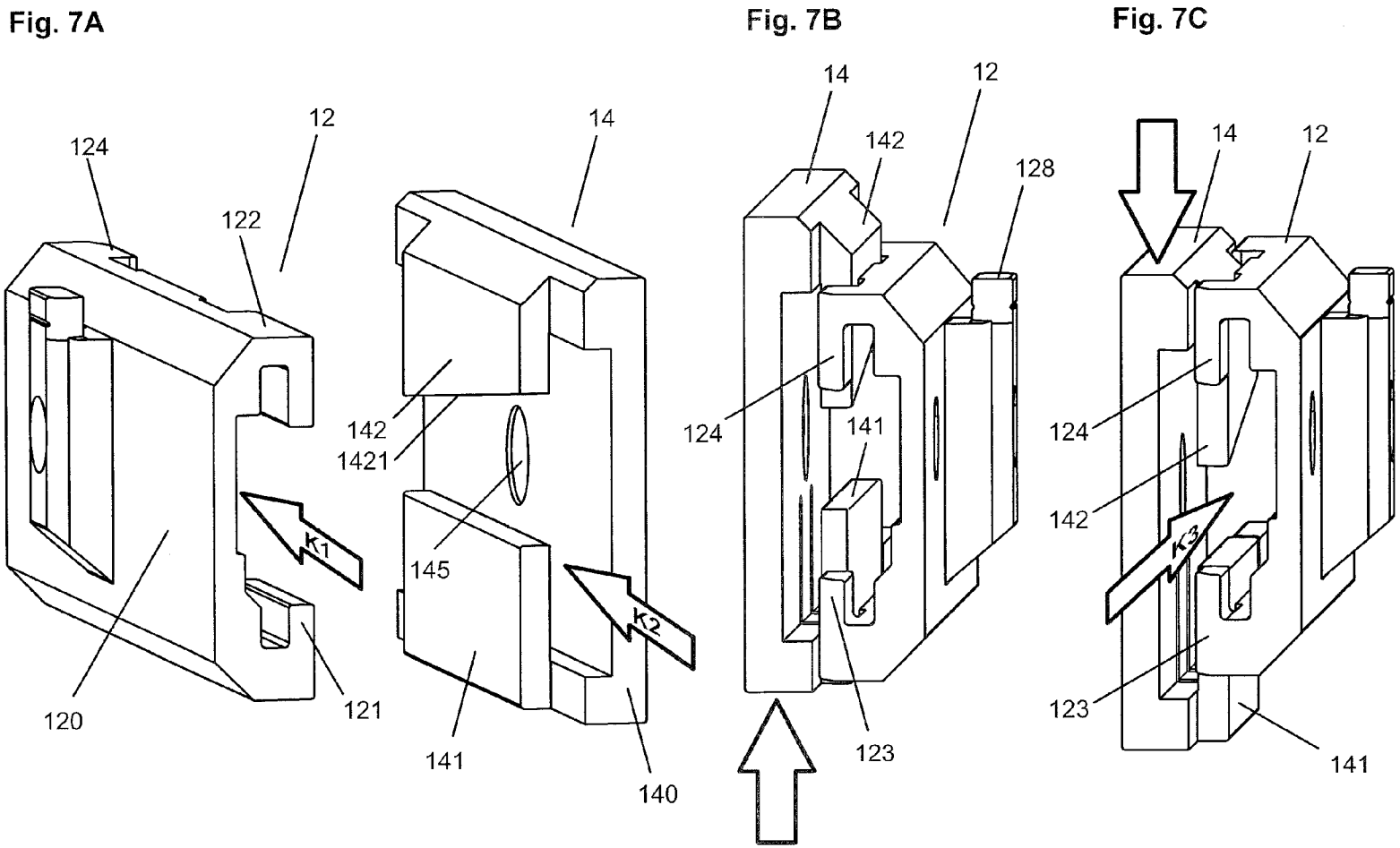
FIG. 7A the carriage body 12 and the mounting body 14 of FIG. 6A released from one another.
FIG. 7B the carriage body 12 and the mounting body 14 of FIG. 6A individually shown in a first mutual operating position without the coupling member 13.
FIG. 7C the carriage body 12 and the mounting body 14 of FIG. 6A individually shown in a second mutual operating position without the coupling member 13.

The carriage body 12, shown in FIGS. 7A, 7B and 7C from different sides, comprises a carriage plate 120 with first holding elements 121, 122 attached thereto in a first section and second holding elements 123, 124 separated therefrom attached thereto in a second section. The two sections, which at least approximately exhibit a form of a C-profile, delimit a first bearing channel K1.

The mounting body 14, shown in FIGS. 5A, 7A, 7B, 7C, 8B and 9B from different sides, comprises a mounting plate 140 with a lower and an upper holding element 141, 142 attached thereto, which also exhibits at least approximately a C-profile shaped section that delimits a second bearing channel K2. FIG. 7A shows that the upper holding element 142 comprises at the lower side a contact surface 1421 that extends inclined relative to the running direction of the carriage.

The coupling member 13, shown in FIGS. 6A, 6B, 8A, 8B, 9A and 9B from different sites, comprises a first coupling element 131 and a second coupling element 132 that are connected with one another via a bridge member 133 that extends inclined relative to the running direction of the carriage. The first coupling element 131 is slidably held in the C-profile shaped sections the carriage body 12, i.e. in the first bearing channel K1. The second coupling element 132 is slidably held in the C-profile shaped section of the mounting body 14, i.e. in the second bearing channel K2.

Figure 9B:
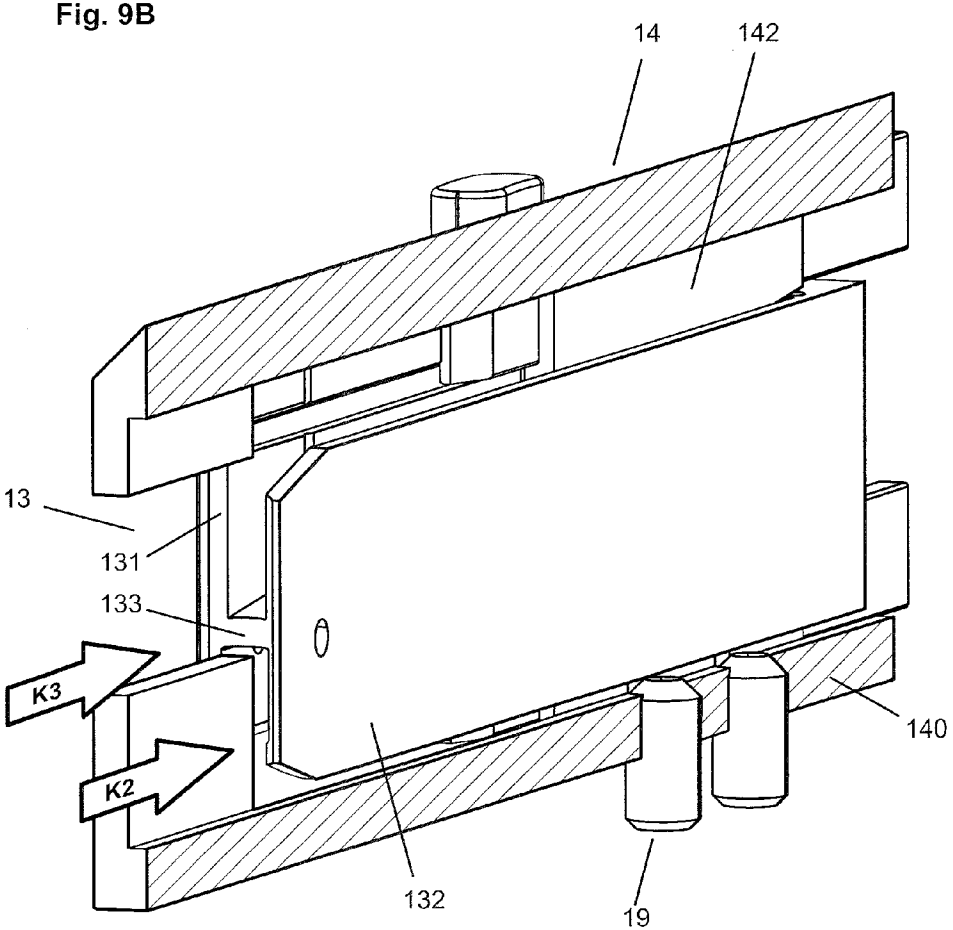
FIG. 9B the coupling member 13 and the mounting body 14 with a cut along the line DD of FIG. 8A.
Figure 9A:
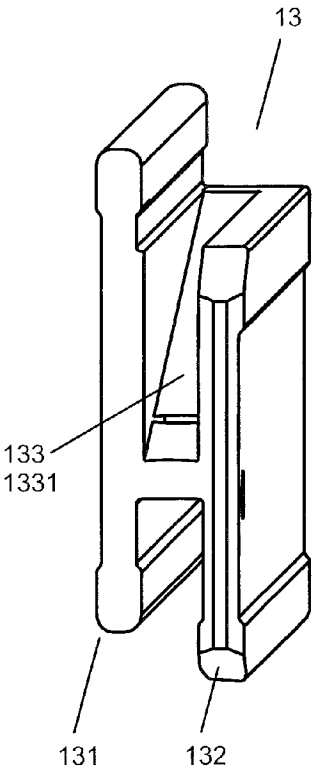
FIG. 9A the coupling member 13 of FIG. 8A in spatial view.

FIG. 9A shows that the upper side of the bridge member 133 exhibits a contact surface 1331, along which the upper holding element 142, i.e. the contact surface 1421 of the upper holding element 142 of the mounting plate 14 is slidable.

FIG. 5B shows a detailed view of the rail 2 with the lower rail element 211, whose upper side forms a roller track 2110, and the upper rail element 221, whose lower side forms a guide track 2210. On the roller track 2110 the track rollers 11 of the carriage 1A are guided. Along the guide track 2210 a gliding element 1281 held by the carriage body 12 is guided contacting or with little play. Hence, between the upper and the lower rail element 211, 221 a running- and guide channel LFK is formed, which receives and guides the running elements 11, 1281 of the carriage 1A, which are preferably arranged in a plane.

Hence, according to the invention a carriage is provided, which can bilaterally be guided in a rail 2 by means of a lower rail element 211 and an upper rail element 221. This embodiment of the rail 2 with a lower and an upper rail element 211, 221 and a carriage 1 with at least one lower running element 11 and at least one upper running element 1281, which are guided along the lower and upper rail elements 211, 221, can be used in any further shifting device with carriages that are adjustable or not. In particular, this solution can be used with rails and carriages that are symmetrically designed and bilaterally provided with running elements and rail elements.

FIG. 5C shows the gliding element 1281 of FIG. 5B released from the guide element 128. The gliding element 1281 is preferably made from plastic having a high lubricity. Instead of the gliding element 1281 also an upper guide roller could be provided, which can run on the guide track 2210.

FIGS. 6A and 6B show the carriage body 12 and the mounting body 14 connected by the coupling member 13 with its first coupling element 131 slidably held in the carriage body 12 and with its second coupling element 132 slidably held in the mounting body 14. With an axial movement of the coupling member 13, the contact surface 1331 of the bridge member 133 slides past the contact surface 1421 of the upper holding element 142 of the mounting body 14 and moves the mounting body 14 vertically.

FIG. 6A further shows that the upper holding element 142 of the mounting body 14 is held between the upper holding elements 122, 124 of the carriage body 12 so that the mounting body 14 can only exercise a vertical movement when the coupling member 13 is axially displaced.

It should be noted that in this embodiment the first coupling element 131 of the coupling member 13 can be shifted only horizontally in the carriage body 12 or in the first bearing channel K1. However, the second coupling element 132 of the coupling member 13 is shiftable horizontally and vertically within mounting body 14, i.e. within the second bearing channel K2, as will be described below with reference to FIG. 9B.

The carriage body 12 and the mounting body 14 as well as their mutual movements are further illustrated in FIGS. 7A, 7B and 7C.

FIG. 7A shows the carriage body 12 and the mounting body 14 with the bearing channels K1 and K2, into which the coupling elements 131, 132 of the coupling member 13 can be inserted.

FIGS. 7B and 7C show that the holding elements 121, 122, 123, 124; 141, 142 of the carriage body 12 and the mounting body 14, which are facing one another, do not extend into the first two bearing channels K1 and K2, but are arranged with little play besides one another and are therefore only vertically movable relative to one another. In FIG. 7B the mounting body 14 is shifted upwards and in FIG. 7C shifted downwards, while the carriage body 12, which is held by the rail 2 during operation of the device, has remained on the same height. Between the holding elements 121, 122, 123, 124 and 141, 142 of the carriage body 12 and the mounting body 14 lies a third bearing channel K3, within which the bridge member 133 of the coupling member 13 can be moved.

Figure 8B:
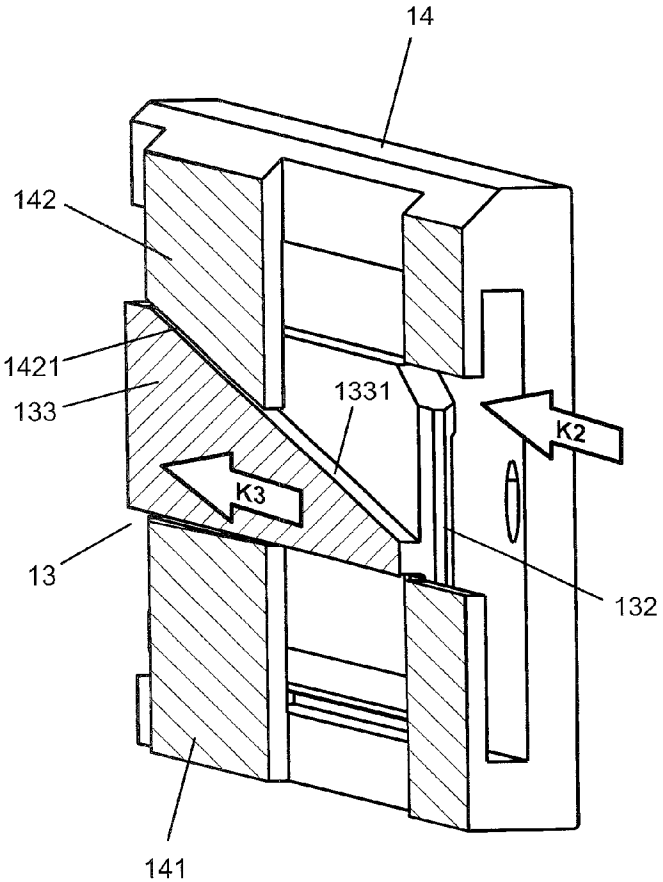
FIG. 8B the coupling member 13 and the mounting body 14 of FIG. 8A with a cut along the line CC of FIG. 8A.
Figure 8A:
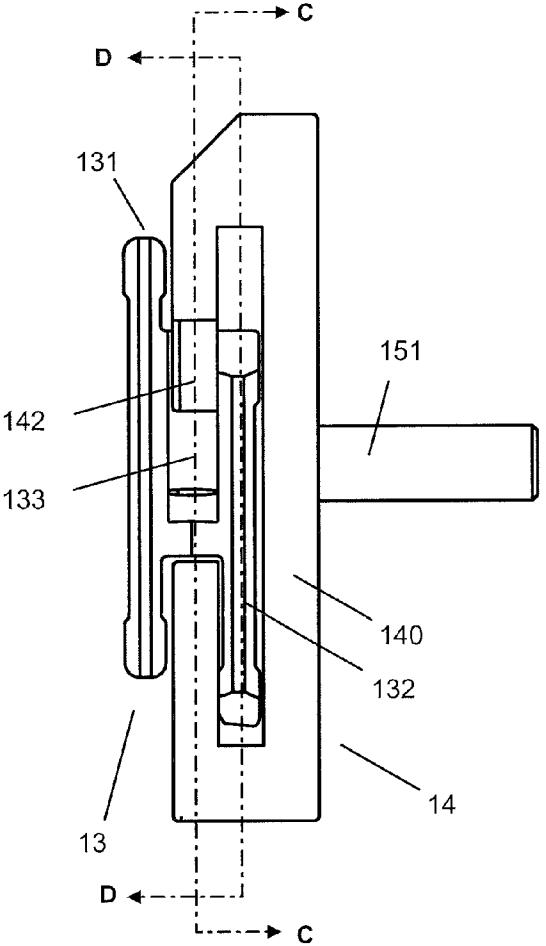
FIG. 8A the coupling member 13 of FIG. 6A inserted into the mounting body 14 as well as cutting lines C-C and D-D.

FIG. 8A shows the coupling member 13 of FIG. 9A inserted into the mounting body 14 as well as cutting lines CC and DD.

FIG. 8B shows the coupling member 13 and the mounting body 14 of FIG. 8A with a cut along line CC of FIG. 8A. The holding elements 141 and 142 of the mounting body 14 as well as the bridge member 133 guided in the third bearing channel K3 are shown hatched. It is shown that the upper holding element 142 of the mounting body 14 with the inclined contact surface 1421 is guided on the contact surface 1331 of the bridge member 133 that is aligned in parallel thereto. If the coupling member 13 is horizontally shifted, then the mounting body 12, which is vertically guided by the holding elements 122 and 124 of the carriage body 12, is shifted upwards or, under the load of the separating element 3, downwards.

FIG. 9A shows the coupling member 13 of FIG. 8A in spatial view.

FIG. 9B shows the coupling member 13 and the mounting body 14 of FIG. 8A with a cut along line DD of FIG. 8A. It is shown that the second coupling element 132 of the coupling member 13 is movable horizontally and vertically within the mounting body 14, i.e. within the second bearing channel K2. Hence, the mounting body 14 can be shifted or adjusted downwards or upwards by a corresponding distance. The second coupling element 132 of the coupling member 13 can then be fixed in a selected position by means of fixing elements 19, e.g. threaded bolts that are held in the mounting body 14.

Figures 10A, 10B:
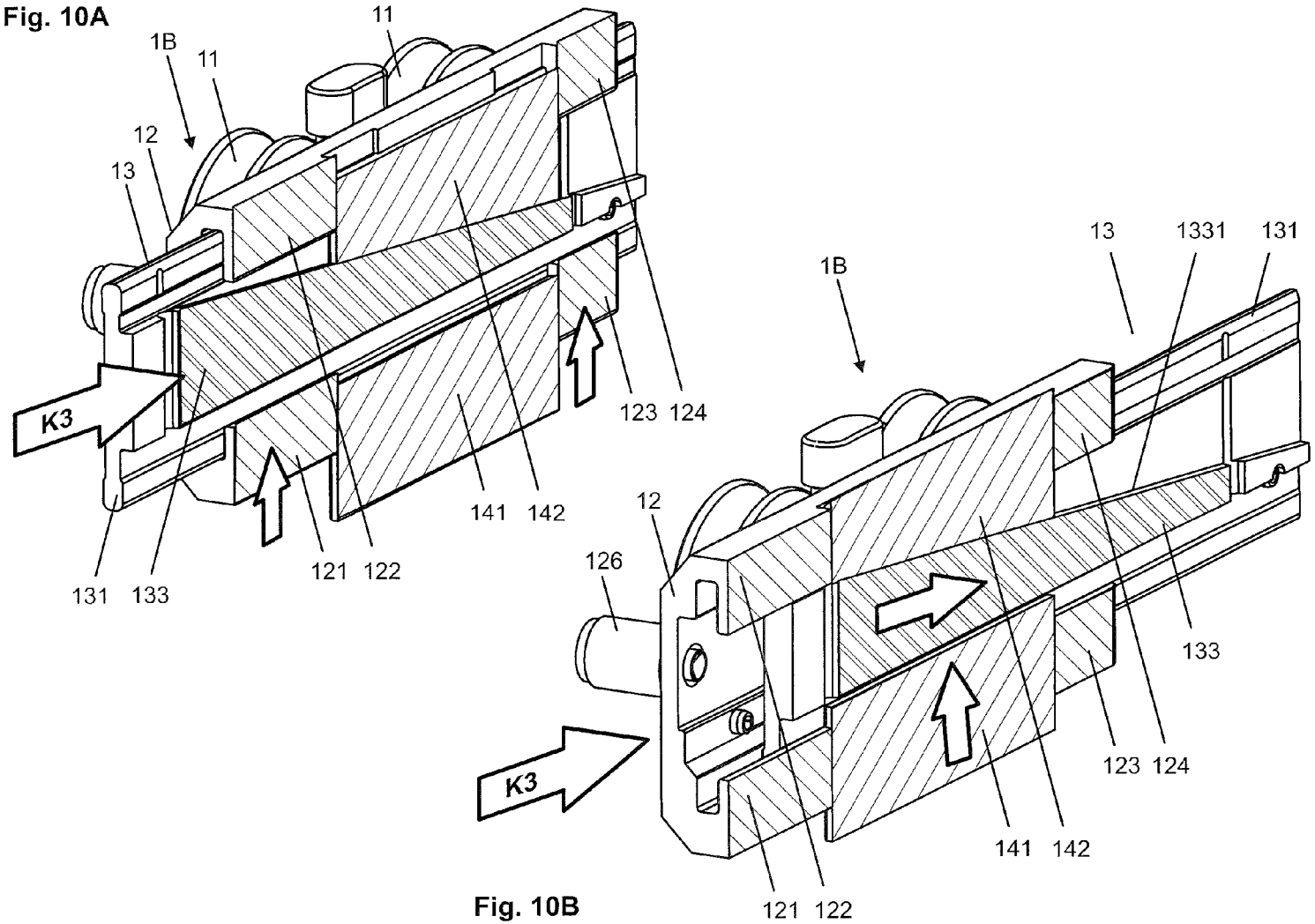
FIG. 10A the carriage 1B with a cut along line BB of FIG. 1A with the coupling member 13 in a first position, in which the mounting body 14 has been shifted downwards.
FIG. 10B the carriage 1B with a cut along line BB of FIG. 1A with the coupling member 13 in a second position, in which the mounting body 14 has been shifted upwards.

FIGS. 10A and 10B show the carriage 1B of FIG. 1A with a cut along the line BB of FIG. 8A. In this view the interaction of all three parts of the carriage 1B is shown, namely the carriage body 12, the horizontally guided coupling member 13 and the vertically guided mounting body 14.

FIG. 10A shows the coupling member 13 in a position, in which the mounting body 14, as shown in FIG. 7B, has been moved vertically downwards. FIG. 10B shows the coupling member 13 in a position, in which the mounting body 14, as shown in FIG. 7C, has been moved vertically upwards.

FIG. 11A shows the separating element 3 with the two carriages 1A, 1B of FIG. 2A, of which the first carriage 1A, i.e. its mounting body 14 has been connected to the retraction device 5, which preferably comprises two retraction units 5A, 5B arranged above one another.

FIG. 11B shows the retraction device 5 of FIG. 11A screwed to the mounting plate 14 of the carriage 1A.

FIG. 11C shows the stop members 6A and 6B of FIG. 1A in a position facing one another, in which they are mounted in the rail 2. It is shown that the stop element 61 of the first stop member 6A is positioned below and the stop element 61 of the second stop member 6B is positioned above, so that the offset stop members 6A and 6B can individually interact with the first and second retraction unit 5A, 5B.

FIGS. 12A and 12B show the advantageous structure of the retraction device 5 with the two retraction units 5A, 5B, which are separated from one another by a housing 53 of the retraction device 5. The housing 53 comprises at its lower side a first device chamber 50A and at its upper side a second device chamber 50B, in which the retraction units 5A, 5B each are arranged. Furthermore, each of the devise chambers 50A and 50B can be covered by a related housing cover 51 or 53.

FIG. 12A shows the lower side of the housing 53 and the upper side of the first housing cover 51, which comprise parts, particularly tracks of a first guide slideway 57A, which correspond to one another. In this first guide slideway 57A a first locking unit 56A with guide cam 567 is bilaterally guided and can be shifted from the current position into a locking range 5701.

The locking unit 56A, which is individually shown in FIG. 14, comprises a tension lever 561, a release lever 562, a first holding member 564 for the retraction spring 54A, a second holding member 565 for the retraction damper 55A as well as, below and above in axial alignment, said guide cams 567.

For the retraction units 5A and 5B, which are inversely arranged above one another, identical locking units 56A and 56B can be used (see FIGS. 13B and 13D). The levers 561, 562, 563 of the locking units 56A, 56B extend during the corresponding operation sequences on the same side out of the retraction device 5 and can and thus interact with the stop members 6A, 6B, which are mounted at the same side member 23 of the rail 2.

The locking unit 56A is connected via the first holding member 564 with a retraction spring 54A and via the second holding member 565 with the plunger 551A of a retraction damper 55A, which comprises a hydraulic cylinder 552A. In the position shown in FIG. 13A the locking unit 56A is coupled via the tension lever 561 with a stop member 6A that is stationary mounted in the rail 2. The retraction spring 54A is not tensioned. The separating element 3 is therefore located in the end position shown in FIG. 2A, in which the first carriage 1A is coupled to the buffer device 4A.

If the separating element 3 is driven away from this end position, then the locking unit 56A remains for the time being coupled to the stop member 6A, wherefore the track 570 of the guide slideway 57A glides past the guide cams 567 until the guide cams 567 are guided along a curve inclined to the running direction into the locking range 5701 and is held therein. By this process the locking unit 56A is turned and decoupled from the stop member 6A. The tension lever 561 is turned against the device chamber 50A and the release lever 562 is turned outwards. During the displacement of the locking unit 56A into the locking range 5701 the retraction spring 5A had been tensioned and is therefore in a state, as shown in FIG. 12B for the retraction spring 54B of the second retraction unit 5B. This second retraction spring 54B had been tensioned in the same way until the related locking unit 56B had been decoupled from the related stop member 6B. During travelling into the end position of the separating element 3 shown in FIG. 2A the locking unit 56B remained held within the locking range 5701 and the retraction spring 54B remained tensioned. The second retraction unit 5B is therefore prepared for the retraction process to take place in the range of the opposite second stop member 6B.

FIG. 12B shows the upper side of the housing 53 and the lower side of the second housing cover 52, which comprise parts each, particularly tracks 570, 5701 of a second guide slideway 57B, which correspond to one another. In this guide slideway 57B the second locking unit 56B is guided, which is connected to a retraction damper 55B and to a retraction spring 54B. The locking unit 57B is held within the locking range 5701 and the retraction spring 56B is tensioned. The release lever 562 is turned outwards and can be catched by the related stop member 6B as soon as the separating element 3 is driven into the related traction range. Subsequently the locking unit 56B is turned, so that also the tension lever 561 can catch the stop member 6B and the force of the released retraction spring 54B can act on the stop member 6B and can pull the separating element 3 into the end position.

FIG. 13A shows the retraction device 5 of FIG. 11A after dismounting the housing 53 and the upper housing cover 52. It is shown that the second retraction unit 5B with the presently tensioned retraction spring 54B is arranged above the first retraction unit 5A and the first and the second locking unit 56A; 56B can interact with the related stop member 6A; 6B at different height levels.

FIG. 13B shows in a first detailed view from above the second locking unit 56B of FIG. 13A, which holds the tensioned second retraction spring 54B. The locking unit 56B has been driven with the guide cams 567 guided along the slideway track 570 into the locking range 5701. The slideway track 570 and the locking range 5701 of the first retraction unit 5A are shown in FIG. 13C. The tension lever 561 has therefore been moved towards the inside and extends no longer into the catching range of the stop member 6B. However, the release lever 562 is in the catching range of the stop member 6B and is catched as soon as the separating element 3 is driven into the traction range. Further shown are the first and the second holding members 564, 565, which hold the tensioned retraction spring 54B and the plunger 551 of the retraction damper 55B. Further shown is a holding element 58A that is integrated in the lower housing cover 51 and that holds the relaxed first retraction spring 54A.

FIG. 13C shows the end piece of the lower housing cover 51 of FIG. 13A in a second detailed view with the lower slideway track 570 of the first slideway guide 57A that extends into the locking range 5701 and that is curved in the end region by approximately 90°.

FIG. 13D shows in a third detailed view the first locking unit 6A that is coupled with the first stop member 6A. It is shown that the stop element 61 of the first stop member 6A is held between the release lever 562 and the tension lever 561, which had been turned outwards after the release lever 562 has hit the stop member 6A. The security lever 563 has also been turned outwards, which fulfils an important security function. In the event that the tension lever 561 does not reach or lose contact with the stop element 61, then the stop element 61 moves over a short distance up to the security lever 563 and is then held by the security level 563. Hence, it is prevented that the locking unit 56A, e.g. during the occurrence a disturbing external impact, can pass the stop member 6A and thus will require manual correction. After the security lever 563 has been coupled with the stop element 61, the retraction spring 54A is discharged in the same manner until the separating element 3 has reached the end stop. In order to securely reach this goal when the security lever 563 is coupled to the stop element 61, the retraction spring 54A is preferably provided with a remaining tension at the end stop. During the next undisturbed closing and opening of the separating element 3, again the tension lever 561 is automatically coupled with the stop member 6A.

Figure 14:
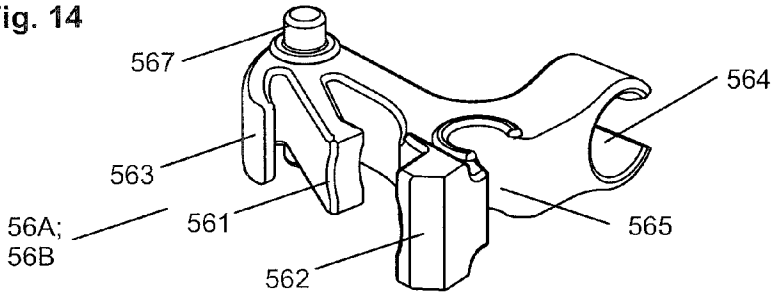
FIG. 14 the first or second locking unit 56A; 56B in spatial view.

FIG. 14 shows in spatial view as an example one of the locking units 56A, 56B which are preferably identical.

REFERENCED LITERATURE

[1] U.S. Pat. No. 7,891,052B2
[2] EP2217782B1

LIST OF REFERENCES

1 carriage
1A carriage with extended mounting body 14
1B carriage
11 lower running element, particularly track roller
110 roller axes
12 carriage body
120 carriage plate
121, 123 lower holding elements
122, 124 upper holding elements
125 mounting bore for receiving the mounting shaft
126 buffer element, particularly bolt
1260 mounting bore for receiving the bolt 126
128 guide element
1281 upper running element, gliding element
13 coupling member
131 first coupling element
132 second coupling element
133 bridge member, running inclined
1331 first coupling surface
14 mounting body
140 mounting plate
141 lower holding element
142 upper holding element
1421 second coupling surface
145 mounting bore
149 connecting element
1490 mounting bore in the connecting element 149
1491 connecting screw
15 connecting device
151 rivet or screw
152 mounting angle
153 mounting cylinder
1531 cylinder element
1532 cylinder flange
154 mounting nut
1541 threaded member
1542 flange member
17 mounting shaft
18 beam
19 fixing screws
2 rail
21 first side member
211 lower rail element
2110 lower rail track, roller track
212 profile element for holding the buffer device
22 central member
221 upper rail element
2210 upper rail track, guide track
23 second side member
231, 232 profile elements for holding the stop members
29 mounting bore
3 plate-shaped separating element, glass plate
31, 31A, 31B recess in the glass plate 3
4A, 4B buffer devices
40 buffer body
401 lower body member
402 upper body member
41 buffer screw
42 holding spring
5 retraction device
5A first retraction unit
5B second retraction unit
50A first device chamber
50B second device chamber
51 first housing cover
52 second housing cover
53 housing
54A, 54B first and second retraction spring
55A, 55B first and second retraction damper
551 plunger
552 cylinder
56A, 56B first and second locking unit
561 tension lever
562 release lever
563 security lever
564 first holding member for the retraction spring
565 second holding member for the damper plunger
567 guide cam
57A, 57B first and second guide slideway
570 guide tracks
5701 locking range
58A holding element for the first retraction spring
59 connecting member
590 mounting bore
6A; 6B first and second stop member
61 stop element
611 threaded bore
K1 first bearing channel
K2 second bearing channel
K3 third bearing channel

The invention claimed is:

1. Carriage for holding and shifting a separating element in a running direction along a rail, comprising a carriage body that holds at least one running element and a mounting body that is slidably connected to the carriage body and that is connectable to the separating element, wherein a coupling member is provided, that comprises a first coupling element and a second coupling element that are connected with one another via a bridge member, wherein the first coupling element is slidably held in the carriage body and the second coupling element is slidably held in the mounting body, and that the bridge member has a first coupling surface that is inclined relative to the running direction and that supports the carriage body or the mounting body, so that with a movement of the coupling member the carriage body and the mounting body are shifted relative to one another.

2. Carriage according to claim 1, wherein the coupling member is slidable at least approximately in parallel to the running direction and that the mounting body or the carriage body is at least approximately slidable perpendicularly to the running direction.

3. Carriage according to claim 1, wherein the first coupling element and the second coupling element are plate-shaped and that the carriage body and the mounting body comprise each one or a plurality of C-profile shaped sections that hold the related first or second coupling element and that engage into one another and are movable relative to one another.

4. Carriage according to claim 1, wherein the mounting body comprises a C-profile shaped section, which is slidably arranged between two C-profile shaped sections of the carriage body.

5. Carriage according to claim 4, wherein the C-profile shaped sections of the carriage body are formed by a carriage plate and pairs of first holding elements attached thereto on opposite sides and that the C-profile shaped section of the mounting body is formed by a mounting plate and a pair of second holding elements attached thereto on opposite sides.

6. Carriage according to claim 5, wherein at least one of the first or second holding elements exhibits a second coupling surface, which is seated on the first coupling surface of the bridge member.

7. Carriage according to claim 5, wherein the carriage plate and the first holding elements attached pairwise thereto delimit a first bearing channel and that the mounting plate and the second holding elements attached pairwise thereto delimit a second bearing channel and that the first or second holding elements which are facing one another delimit a third bearing channel and that the first coupling element is slidably held in the first bearing channel, the second coupling element is slidably held in the second bearing channel and that the bridge member of the coupling member is slidably held in the third bearing channel.

8. Carriage according to claim 5, wherein the mounting plate, which can laterally be mounted on the separating element, has a mounting bore, through which a mounting screw is guided that holds a mounting cylinder, which comprises a cylinder element that can be inserted into a cylindrical opening in the separating element.

9. Carriage according to claim 1, wherein the carriage body is connected with a buffer element and with a mounting shaft that pivotally holds a beam with a roller shaft mounted on each end of the beam that holds a running element designed as a track roller.

10. Shifting device with a first carriage and a second carriage according to claim 1, wherein the two carriages are guided in a rail and are connected to a separating element.

11. Shifting device according to claim 10, wherein the first carriage is releasably connected to a retraction device that is arranged within recess in the separating element and that comprises at least one retraction unit with a retraction spring, a retraction damper, a one-sided or two-sided guide slideway and a locking unit, wherein the locking unit comprises a) a first holding member for holding and tensioning the retraction spring;

b) a second holding member for holding a plunger serving for actuating the retraction damper;

c) two guide cams that can be guided within a locking range in tracks of the guide slideway; and d) at least one lever member that can be actuated by a stationary mounted stop member, when moved along the rail.

12. Shifting device according to claim 11, wherein the retraction device comprises a first retraction unit and a second retraction unit that are arranged each in a device chamber that are separated from one another by a functional housing, which functional housing comprises a first housing member on one side which serves for receiving the first retraction unit and which is covered by a first housing cover, and which functional housing comprises a second housing member on the opposite side, which serves for receiving the second retraction unit and which is covered by a second housing cover.

13. Shifting device according to claim 12, wherein the first housing member and the first cover each comprise tracks and a locking section that corresponding to one another to form the tracks and the locking range of said guide slideway of the first retraction unit, and that the second housing member and the second housing cover each comprise tracks and a locking section that corresponding to one another to form the tracks and the locking range of said guide slideway of the second retraction unit.

14. Shifting device according to claim 13, wherein a first and a second stop member are provided that are plate-shaped and comprise in the lower half a stop element, and that are held in the rail in such a way, that the stop elements are vertically offset relative to one another and extend into the cross-section of the rail.

15. Shifting device according to claim 10, wherein in the rail at least one buffer device is mounted, which is facing a related carriage.

* * * * *